US007880104B2

(12) United States Patent
Grieshaber et al.

(10) Patent No.: US 7,880,104 B2
(45) Date of Patent: Feb. 1, 2011

(54) CONTROL DEVICE FOR CONTROLLING ELECTRICAL SWITCHGEAR

(75) Inventors: Wolfgang Grieshaber, Lyons (FR); Jean-Pierre Dupraz, Bressolles (FR); Olivier Grejon, Sathonay Camp (FR); Alain Fanget, Tramoyes (FR); Xavier Allaire, Chassieu (FR); Michel Collet, Lyons (FR)

(73) Assignee: Tour Areva, Paris la Defense Cedex (FR)

( * ) Notice: Subject to any disclaimer, the term of this patent is extended or adjusted under 35 U.S.C. 154(b) by 1078 days.

(21) Appl. No.: 11/642,321

(22) Filed: Dec. 19, 2006

(65) Prior Publication Data

US 2007/0137994 A1 Jun. 21, 2007

(30) Foreign Application Priority Data

Dec. 20, 2005 (FR) ..... 05 53967

(51) Int. Cl.
*H01H 5/00* (2006.01)

(52) U.S. Cl. ..... 200/400; 200/501

(58) Field of Classification Search ..... 200/400
See application file for complete search history.

(56) References Cited

U.S. PATENT DOCUMENTS

| | | | | |
|---|---|---|---|---|
| 5,151,567 | A * | 9/1992 | Thuries | 218/84 |
| 5,504,289 | A | 4/1996 | Smith et al. | 200/400 |
| 6,573,468 | B2 * | 6/2003 | Sfondrini et al. | 200/501 |
| 7,009,130 | B2 * | 3/2006 | Hashimoto et al. | 200/400 |

FOREIGN PATENT DOCUMENTS

| | | | |
|---|---|---|---|
| DE | 19504714 | A1 | 8/1996 |
| FR | 2778492 | A1 | 11/1999 |

OTHER PUBLICATIONS

Preliminary Examination Search Report, FA675428, 6 pgs, (Jan. 9, 2006).

* cited by examiner

*Primary Examiner*—Renee Luebke
*Assistant Examiner*—Lheiren Mae A Caroc
(74) *Attorney, Agent, or Firm*—Nixon Peabody LLP

(57) ABSTRACT

A control device for controlling electrical switchgear such as a circuit breaker or the like includes an actuating arm having a connection point suitable for being moved along a closed line including points P1, P2 and P3. The connection point thus moves during an opening stage for opening the moving contact, under the effect of a mechanical spring from point P1 to point P2. It also moves during a re-cocking stage for re-cocking the mechanical spring under the effect of a motor being switched on, and while keeping the moving contact in the open position, from point P2 to point P3. It also moves during a closure stage for closing the moving contact, also under the effect of the motor being switched on, from point P3 to P1. In this manner it is possible to successively perform three distinct stages of putting the actuating arm in motion, between the instant at which the moving contact leaves its closed position and the instant at which it returns thereto after having occupied its open position. A re-cocking stage for re-cocking the mechanical spring that is distinct from the closing stage and from the opening stage for closing and opening the moving contact, is performed, with the opening stage to be performed merely by releasing the energy that has been previously accumulated by the spring.

50 Claims, 23 Drawing Sheets

CONTROL DEVICE FOR CONTROLLING ELECTRICAL SWITCHGEAR

CROSS REFERENCE TO RELATED APPLICATIONS OR PRIORITY CLAIM

This application claims priority of the French Patent Application No. 05 53967 filed Dec. 20, 2005.

The present invention relates to a control device for controlling electrical switchgear having a moving contact that is suitable for occupying a closed position and an open position.

The term "electrical switchgear" is used herein broadly to designate a circuit-breaker, a disconnector, or indeed a grounding device. Switchgear combining these various functions, such as a circuit-breaker-and-disconnector, is also included.

It is known from the prior art that it is possible to implement devices that are "combined-design" devices in that they incorporate both an electric motor and a mechanical spring system for performing closure and opening of the moving contact of the switchgear. The motor then makes it possible to control, via suitable servo-control, the various functions of the electrical switchgear, such as opening and closing the contacts thereof.

Although such solutions are in widespread use, they suffer from drawbacks, such as those resulting from the combined or simultaneous use of power from the motor and of energy from the spring to perform both the moving contact opening stage and the moving contact closure stage.

In order to be able to use the energy from the spring during one of those stages, it is necessary to cause the spring to accumulate said energy during the other of the stages, and vice-versa. Thus, that requirement to stress the mechanical spring during both of the stages usually results in using motors that are over-dimensioned so as to reach the opening and closure speeds that are required for the moving contact.

In addition, that type of combined design for the control device generally requires opening and closure strokes to be provided for the moving contact that are longer than necessary, which makes the device more complex, heavier, and less compact.

An object of the invention is thus to propose a control device that is of simpler and more reliable design for controlling electrical switchgear that is preferably of the medium-voltage or high-voltage type.

To this end, the invention provides a control device for controlling electrical switchgear for interrupting electrical energy, said switchgear including a moving contact that is suitable for occupying a closed position and an open position, said control device being designed to move said moving contact and comprising a motor, a mechanical spring and an actuating arm having a first connection point and a second connection point. According to the invention, the actuating arm is suitable for occupying a closure position making it possible to place the moving contact in its closed position and in which the second connection point is situated at a point P1, an opening position making it possible to place the moving contact in its open position and in which the second connection point is situated at a point P2 that is distinct from P1, and a re-cocked position in which the second connection point is situated at a point P3 that is distinct from P2 and P1, said control device being designed so that said second connection point can be moved successively along a closed line including said points P1, P2, and P3:

during an opening stage for opening the moving contact, under the effect of said mechanical spring, from point P1 to point P2;

during a re-cocking stage for re-cocking the mechanical spring, under the effect of the motor being switched on, and while keeping the moving contact in the open position, from point P2 to point P3; and during a closure stage for closing the moving contact, also under the effect of the motor being switched on, from point P3 to P1.

The principle of the invention is thus based on a design making it possible to perform successively three distinct stages of putting the actuating arm in motion, between the instant at which the moving contact leaves its closed position and the instant at which it returns thereto after having occupied its open position. Unlike in prior art devices, provision is made to perform a re-cocking stage for re-cocking the mechanical spring that is distinct from the closing stage and from the opening stage for closing and opening the moving contact, it being possible for the opening stage to be performed merely by releasing the energy that has been previously accumulated by the spring. Therefore, throughout the closure stage for closing the moving contact, which stage is complete when said moving contact reaches its closed position, the spring does not need to accumulate any energy, so that the stroke of the contact is fully controlled, and requires less energy than the energy required in prior art devices. The closure stage can thus be implemented by means of a motor of lower power than in the prior art.

In addition, implementation of the opening stage is extremely reliable due to the fact that it advantageously does not require the electric motor to be switched on at all, but rather it can be performed automatically merely by releasing energy from the spring as soon as the locking means for locking the moving contact in the closed position have been deactivated.

The re-cocking stage for re-cocking the spring does not generate any movement of the moving contact which thus remains in its open position, preferably without the assistance of any locking means but rather merely by the specific design and the specific geometrical shape of the control device. The sole purpose of this stage is to have the spring accumulate energy, before the contact starts its closure stage during which it is moved towards its closed position. Therefore, it should be understood that the design proposed by the invention advantageously makes it possible to obtain a stroke for the contact that is fully optimized because said stroke does not go beyond the stroke that is just necessary to travel between the open position and the closed position of the moving contact.

In addition, the closure stroke of the moving contact is fully controlled, since it is performed by switching on the motor and it does not generate any stress on the spring which has already been re-cocked sufficiently to be capable subsequently of performing the opening stage alone. Here too, because of the fact that there is no need to put the spring under stress during said closure stage, the power required to move the moving contact at the desired speed to its closed position is lower than the power required in prior art devices, so that the motor used can therefore be of lower power and therefore be less costly.

Preferably, as mentioned above, the control device is designed so that, during said closure stage for closing the moving contact, resulting in said second connection point being moved from point P3 to point P1, the energy stored in the mechanical spring does not vary, i.e. said mechanical spring does not release or accumulate any energy during this stage.

It is however indicated that said device could be designed so that the spring acts to accelerate the instant of initiation of the moving contact closure stage by releasing a fraction of its energy that is previously accumulated, in addition to the power delivered by the motor, and/or acts as a brake at the end of the moving contact closure stage by said spring being put under stress.

Preferably, the closed line has a shape that is roughly a triangle, the points P1, P2, P3 preferably constituting the vertices of said triangle, each of the three sides then corresponding to a respective path for the second connection point of the actuating arm, during a respective one of the above-mentioned three distinct stages.

In preferred manner, the device is designed so that said opening stage for opening the moving contact, resulting in said second connection point being moved from point P1 to point P2, is performed under the effect of the mechanical spring only, so as to obtain very high reliability, or is performed in a manner such that the motor assists said mechanical spring.

It is then possible to make provision for the control device to deliver either a linear output movement or a rotary output movement to the moving contact. In addition, in order to control the moving contact closure stage fully, a motor of the servomotor type is preferably used.

Preferably, the position of the moving contact is servo-controlled during said closure stage, relative to a setpoint that is in the form of a mathematical function of time. Similarly, it is possible for the speed of the moving contact to be servo-controlled during said closure stage, relative to a setpoint in the form of a mathematical function of time, and for acceleration of the moving contact to be servo-controlled during the closure stage, also relative to a setpoint in the form of a mathematical function of time.

Also preferably, the device further comprises means making it possible to accumulate the energy that is given off during said opening stage for opening the moving contact under the effect of the mechanical spring relaxing, said means being designed to transfer said accumulated energy to said mechanical spring, during said re-cocking stage for re-cocking said spring. This transfer of energy advantageously makes it possible to facilitate initiation of the re-cocking stage for re-cocking the spring, normally performed by the motor. By way of example, the energy is accumulated and delivered by means of a flywheel, such as a Maltese cross. The flywheel is then caused to turn at the end of the opening stage under the action of a moving part, and, similarly, it initiates the re-cocking stage by delivering the accumulated kinetic energy to the spring. Naturally, it is noted that the energy stored/accumulated by the flywheel during the opening stage is constituted by a fraction of the energy delivered by the spring and/or by the motor that is thus no longer used to drive the end of the movement of the moving contact. As a result, said fraction of the energy, which fraction is different from the fraction that enabled the moving contact to reach the required opening speed can be termed "surplus energy" given off by the spring and/or by the motor, during the end of the opening stage.

Preferably, the second connection point of the actuating arm is constituted by a finger guided along a path defined at least in part physically on a stationary body, and following said closed line.

Thus, the path defined at least in part structurally on the stationary body may be implemented in any manner known to the person skilled in the art, e.g. by means of guides disposed on one side or both sides of and adjacent to the path in order to follow the closed line, or else by means of a groove provided in the stationary body and receiving the above-mentioned finger, as in the first preferred embodiment which is described below. Although provision is made for the path to be defined in full physically on a stationary body, provision may alternatively be made, as appears from the above, for the path to be defined in part otherwise than structurally on the stationary body. It can, in particular, be noted that in those portions of the path which are not defined structurally, the second connection point is, for example, guided along the path due to the specific position of transmission means which are described below and which are connected to said second point, and due to the positions of pulleys or wheels designed to be associated with said transmission means.

Another alternative could also, without going beyond the ambit of the invention, consist in making provision for the path not be defined at all structurally on a stationary body, but rather, for example, to be made up of a succession of straight and curved segments along which the second connection point is capable of being moved merely by the design and by the positioning of the transmission means and of the pulleys or wheels associated with said transmission means, which means are naturally designed to co-operate with the second connection point. In other words, provision is thus made for the path to be made up of a succession of straight and curved segments defined by the transmission means and by a set of pulleys or wheels that are arranged appropriately.

In a first preferred embodiment of the present invention in which the path is defined in full physically on stationary body, the second connection point of the actuating arm is constituted by a finger guided in a groove extending along said closed line and provided in a stationary body. Thus, said finger is capable of moving in its associated groove, by sliding and/or by rolling, without going beyond the ambit of the invention.

In this first embodiment, transmission means are provided that are interposed between said mechanical spring and said actuating arm, said transmission means being connected pivotally to said finger. They are preferably in the form of a chain or a cable that is kept under tension continuously either directly or via at least one wheel while the actuating arm is being put in motion. However, it is possible to use other transmission means known to the person skilled in the art, such as, for example means of the following types: strap; belt; cog belt; linkage made up of hinged links; tape; cord; bundle of fibers; etc. More generally, the transmission means preferably chosen present a linear configuration.

In addition, it is noted that said means are preferably also kept under tension outside the stages during which the actuating arm is put in motion.

In a first alternative of the first preferred embodiment, provision is made for that portion of the closed line which is defined between the points P1 and P2 to be rectilinear at least in part, and preferably rectilinear in full. In which case, the device is then preferably designed so that when the second connection point is situated at point P1, the actuating arm, the transmission means and an axis of said mechanical spring are aligned, preferably in a direction defined by the points P1 and P2.

In a second alternative of the first preferred embodiment, provision is made for that portion of the closed line which is defined between the points P1 and P2 to be a portion that is concave in shape, at least in part. However, that portion could be a portion that is convex in shape, at least in part, or else a portion that includes a concave zone associated with a rectilinear zone, without going beyond the ambit of the invention. Depending on the needs encountered, it is thus possible to have a portion that includes at least one rectilinear zone, and/or at least one concave zone, and/or at least one convex zone.

For these two alternatives, provision is preferably made for the two portions of the closed line that are defined respectively between the points P2 and P3, and between the points P3 and P1 to be portions that are convex in shape, at least in part, and preferably in full, each portion having, for example, the shape of an arc of a circle. Here too, it is possible to make provision for each of the portions to include at least one rectilinear zone, and/or at least one concave zone, and/or at least one convex zone. It is thus possible for the two portions of the closed line that are defined respectively between the points P2 and P3, and between the points P3 and P1 to be portions that are preferably concave in shape, at least in part.

Preferably, in this first preferred embodiment, the device further comprises a first control lever driven by said motor in a manner such that it is capable of bringing said finger from point P2 to point P3 by being in contact with said finger, and further comprises a second control lever driven by said motor in a manner such that it is capable of bringing said finger from said point P3 to point P1 by being in contact with said finger. Thus, in this preferred embodiment, in which the stud is situated in the groove, it is naturally to be understood that the stud moves by sliding and/or rolling along the groove.

In addition, provision is made for the first and second control levers to be put in motion simultaneously by said motor, during the re-cocking phase for re-cocking the mechanical spring and during the closure stage for closing the moving contact. As a result, it is advantageously possible to have a single motor for driving both of the levers which have different functions, thereby significantly simplifying the design of the control device. However, it is also possible to make provision for the first and second control levers to be put in motion independently by said motor, respectively during the re-cocking stage for re-cocking the mechanical spring and during the closure stage for closing the moving contact.

In a second embodiment of the present invention, the device further comprises a gear system provided with a stationary inner ring of radius R1, with a planet wheel of radius R2 that meshes externally with said ring, and with a planet wheel holder having a rotary shaft arranged on a central axis of said inner ring, said second connection point of the actuating arm being constituted by a finger that is rotatably mounted on said planet wheel, said planet wheel having a central axis that is parallel to a central axis of the finger and that is spaced apart therefrom by a distance d1.

This arrangement makes it possible to have the second connection point describe a closed line of the hypocycloid type, which is well adapted to re-creating the desired cycle for putting the actuating arm in motion.

The device further comprises transmission means interposed between said mechanical spring and said actuating arm, said transmission means being connected pivotally to said planet wheel so as to be capable of pivoting relative thereto about a pivot axis that is parallel to the central axis of the planet wheel and that is spaced apart therefrom by a distance d2. Here too, the transmission means are preferably in the form of a chain or a cable that is kept under tension continuously either directly or preferably via at least one wheel while the actuating arm is being put in motion. However, it is possible to use other transmission means known to the person skilled in the art, such as, for example means of the following types: strap; belt; cog belt; linkage made up of hinged links; tape; cord; bundle of fibers; etc. More generally, the transmission means preferably chosen present a linear configuration. In addition, it is noted that said means are preferably also kept under tension outside the stages during which the actuating arm is put in motion.

In the following alternatives, the parameters R1 and R2 are set in a manner such that they satisfy the following condition: (1) $5>R1/R2>1$; and preferably the more restrictive condition: (2) $R1/R2=3$; which makes it possible, in particular to satisfy the condition of periodicity of the three distinct stages. It is noted that the value of the ratio of the radii R1/R2 given above also corresponds to the ratio of the number of teeth carried by the ring and the number of teeth carried by the planet wheel.

In a first alternative of the second preferred embodiment, the above-mentioned pivot axis of the transmission means and said central axis of the finger coincide, implying that the value of d1 is equal to the value of d2.

In which case, it is possible to make provision for the parameters R1, R2 and d1 to be set in a manner such that they satisfy the following condition: (3) $2>d1/R2>0.2$; and more preferably the condition (4) $d1/R2=1/3$; also preferably while satisfying the condition (2) $R1/R2=3$. Naturally, the ratio R1/R2 may lie in the range 0.3 to 0.4 or in a wider range extending from 0.2 to 2.

In the specific case when the provision is made for $d1/R2=1/3$, the closed line along which the second connection point moves during the cycle for putting the actuating arm in motion then has a shape that is roughly a triangle whose sides are substantially convex in shape.

In a second alternative of the second preferred embodiment, the above-mentioned pivot axis of the transmission means and said central axis of the finger are distinct.

In which case, the parameters R1, R2, d1, and d2 are set in a manner such that they satisfy the following conditions: (2) $R1/R2=3$; (3) $2>d1/R2>0.2$; and (5) $2>d2/R2>0.2$.

More preferably, provision is made for the parameters R1, R2, d1, and d2 to be set such that they satisfy the following conditions: (6) $d1/R2=1$; and (7) $d2/R2=1/3$, also preferably while satisfying the condition (2) $R1/R2=3$.

Here too, the values for this second alternative are given only by way of illustrative example, and they are thus non-limiting. It is noted that the three conditions indicated above make it possible for the closed line along which the second connection point moves to have a shape that is roughly a triangle, whose sides are substantially concave in shape.

In addition, the gear system is further provided with a toothed wheel driven by said motor and rotatably mounted on said rotary shaft of the planet wheel holder, said toothed wheel being coupled mechanically to said planet wheel holder so as to allow said planet wheel holder to turn freely about its shaft during the opening stage for opening the moving contact during which said finger is moved from point P1 to point P2 under the effect of the mechanical spring, and so as to entrain said planet wheel holder in rotation with it during the re-cocking stage for re-cocking the spring and during the closure stage for closing the moving contact, during which stages the finger is moved respectively from point P2 to point P3 and from point P3 to P1, under the effect of the motor being switched on, thereby causing said toothed wheel to turn.

For this purpose, it is possible to make provision for the toothed wheel to be coupled mechanically to said planet wheel holder via a circular groove provided over an angular sector of said toothed wheel, and passing a shaft of the planet wheel holder, which shaft carries said planet wheel in freely rotatable manner and is arranged on the central axis of said planet wheel.

In the second preferred embodiment of the present invention, the motor is designed to assist the spring during the opening stage, e.g. during a portion only of the opening stage.

Provision is then made for the motor to assist the spring and to make it possible, during the opening stage, to servo-control the position of the moving contact relative to a setpoint that is in the form of a mathematical function of time. Similarly, provision is made for the motor to assist the spring and to make it possible, during the opening stage, to servo-control the speed of the moving contact relative to a setpoint that is in the form of a mathematical function of time, and/or to servo-control the acceleration of the moving contact relative to a setpoint that is in the form of a mathematical function of time.

Naturally, provision is made for the device to be designed such that the moving contact can be opened even when the motor is not able to assist the spring or to servo-control the parameters of the opening of the moving contact.

The invention also provides electrical switchgear having a moving contact suitable for occupying a closed position and an open position, said electrical switchgear including a control device as defined above.

Finally, the invention provides a method of controlling electrical switchgear, said method being implemented by means of a control device as defined above.

Other characteristics and advantages of the present invention appear from the following detailed description given with reference to the accompanying drawings, in which:

FIGS. 1*a* to 1*c* diagrammatically show the principle of the invention, by showing the control device at various stages during a control cycle starting from an instant at which the moving contact is in its closed position, and continuing until said moving contact returns to the same position after having been in its open position;

Figure 3:
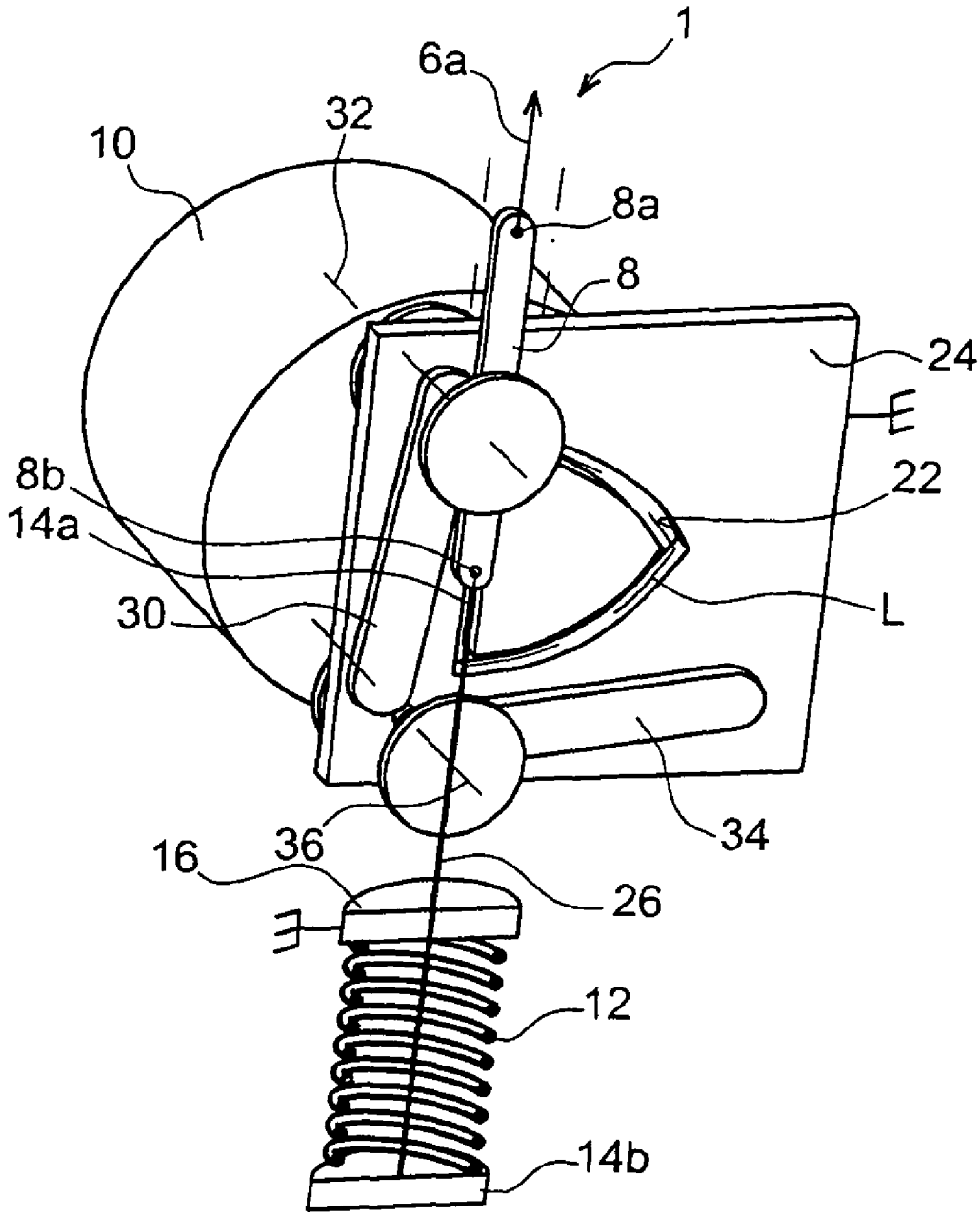
FIG. 3 is a perspective view of a control device in a first alternative of a first preferred embodiment of the present invention.
Figure 5:
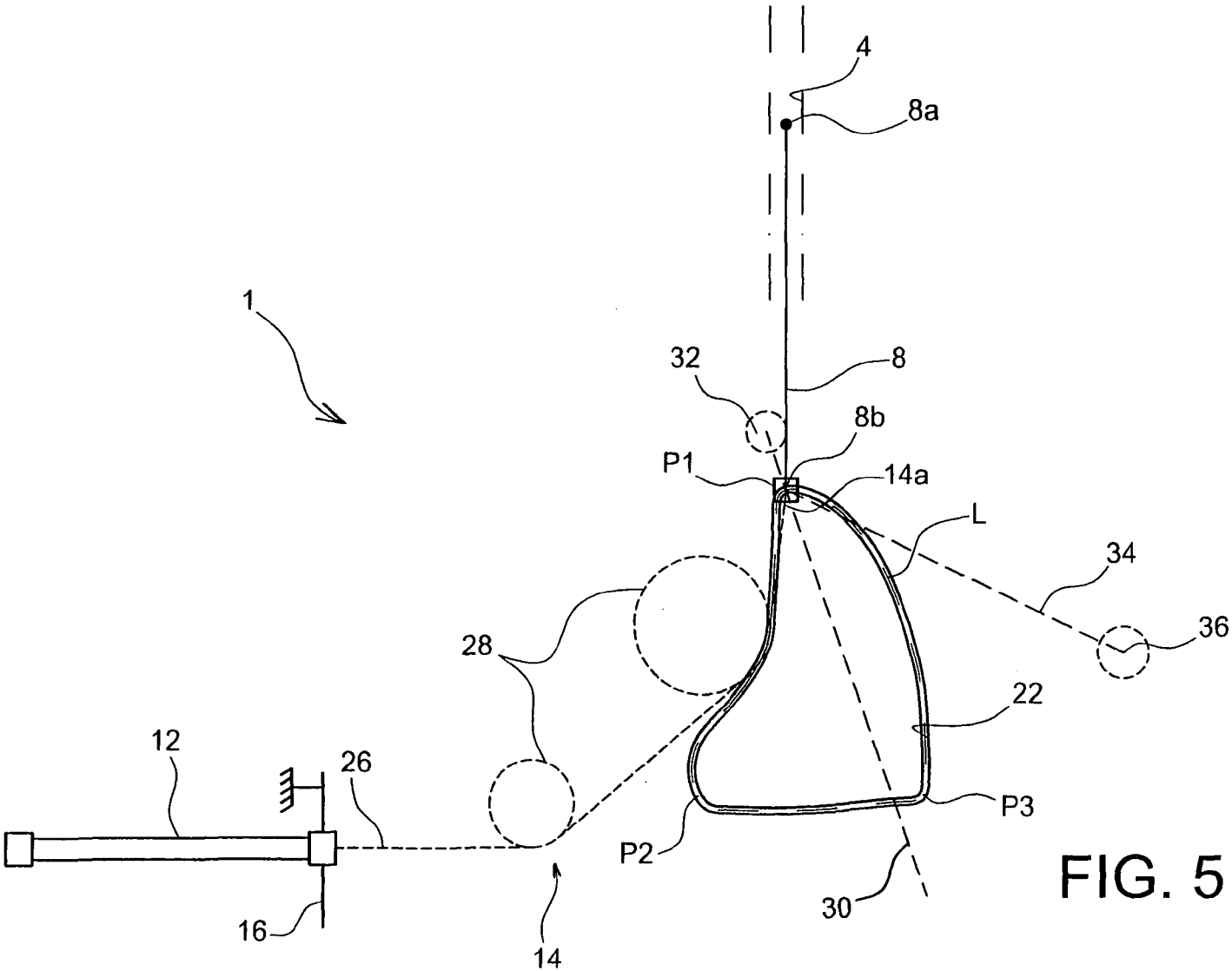
Figure 6A:
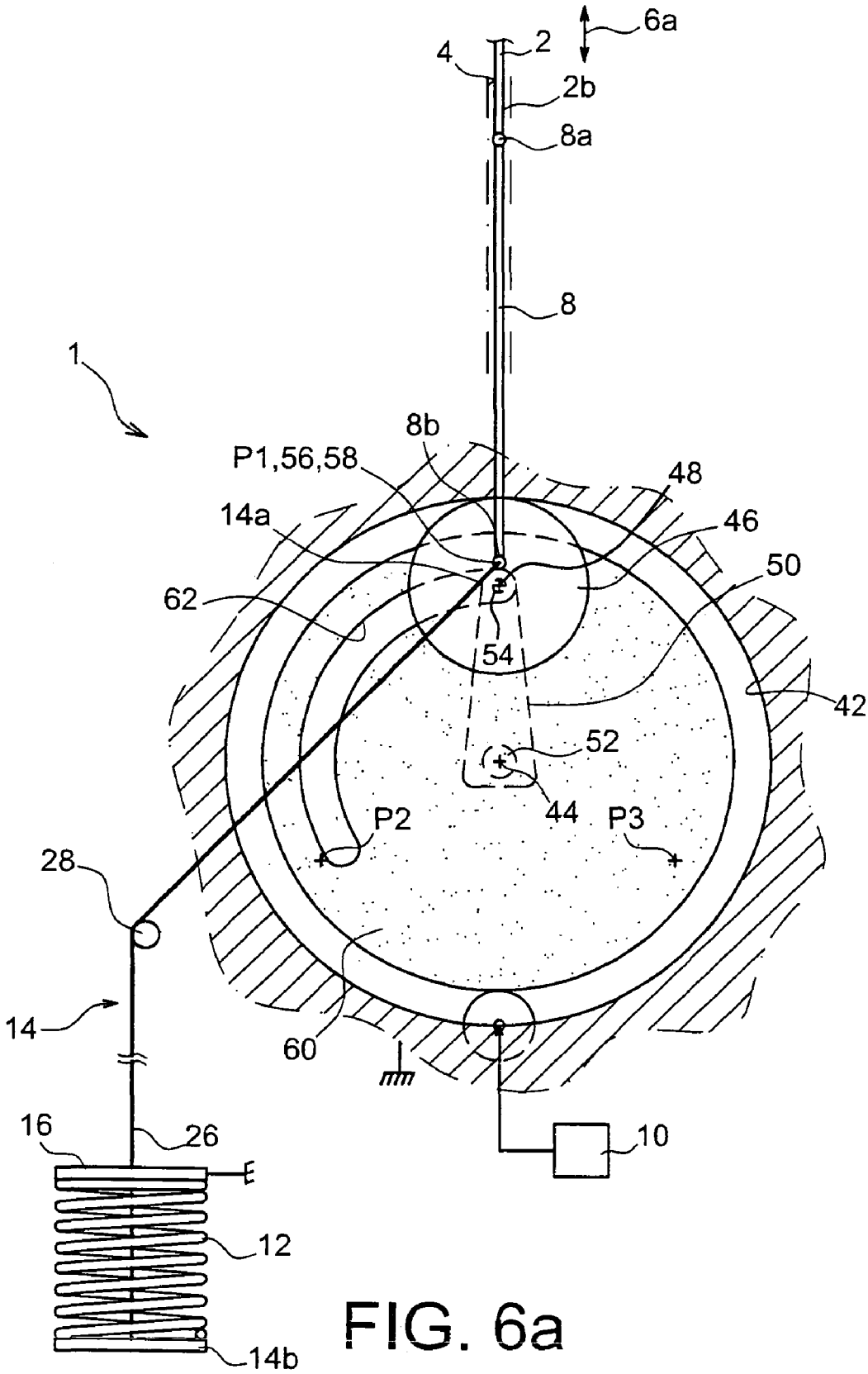
Figure 6B:
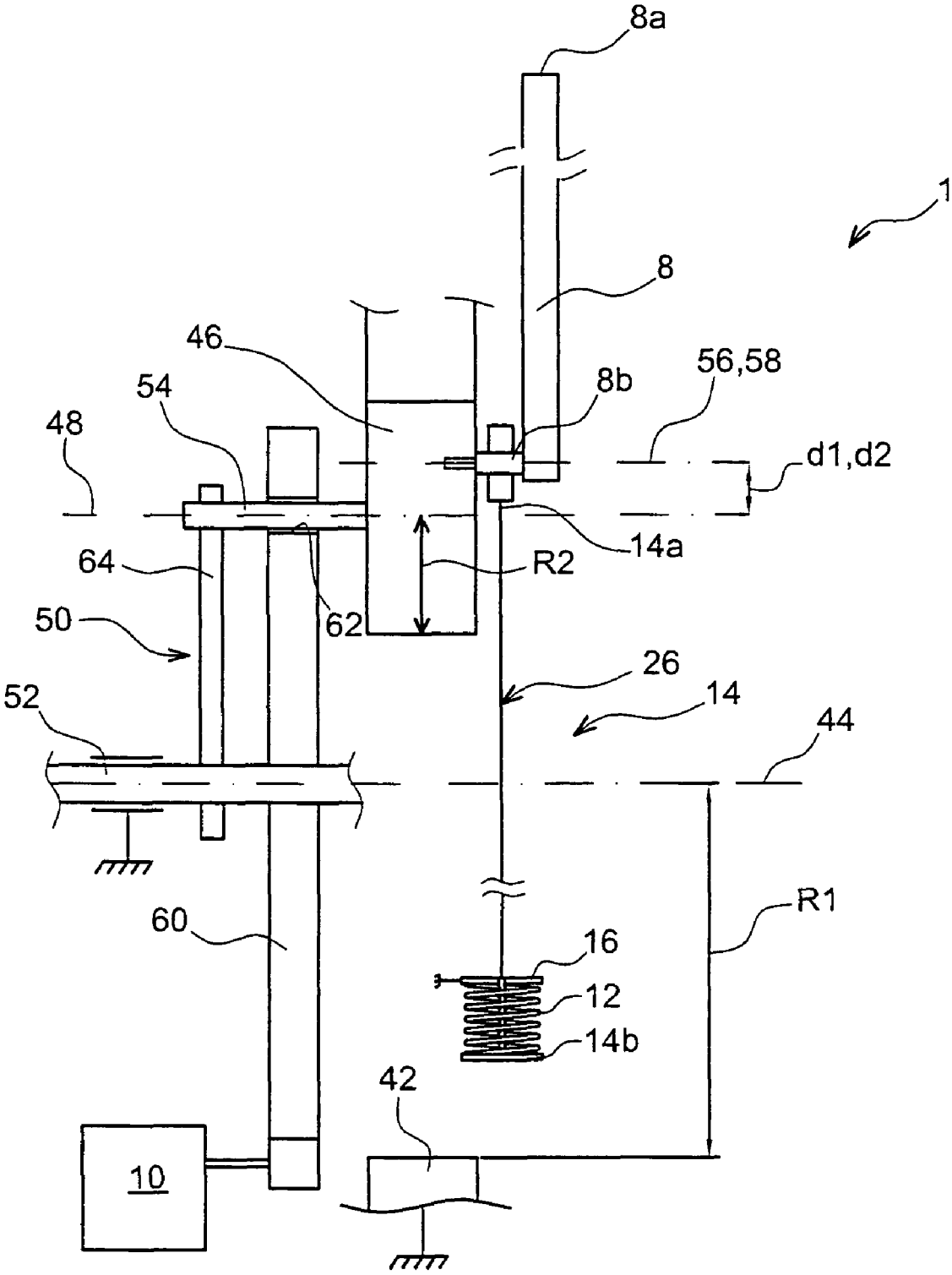
Figure 7:
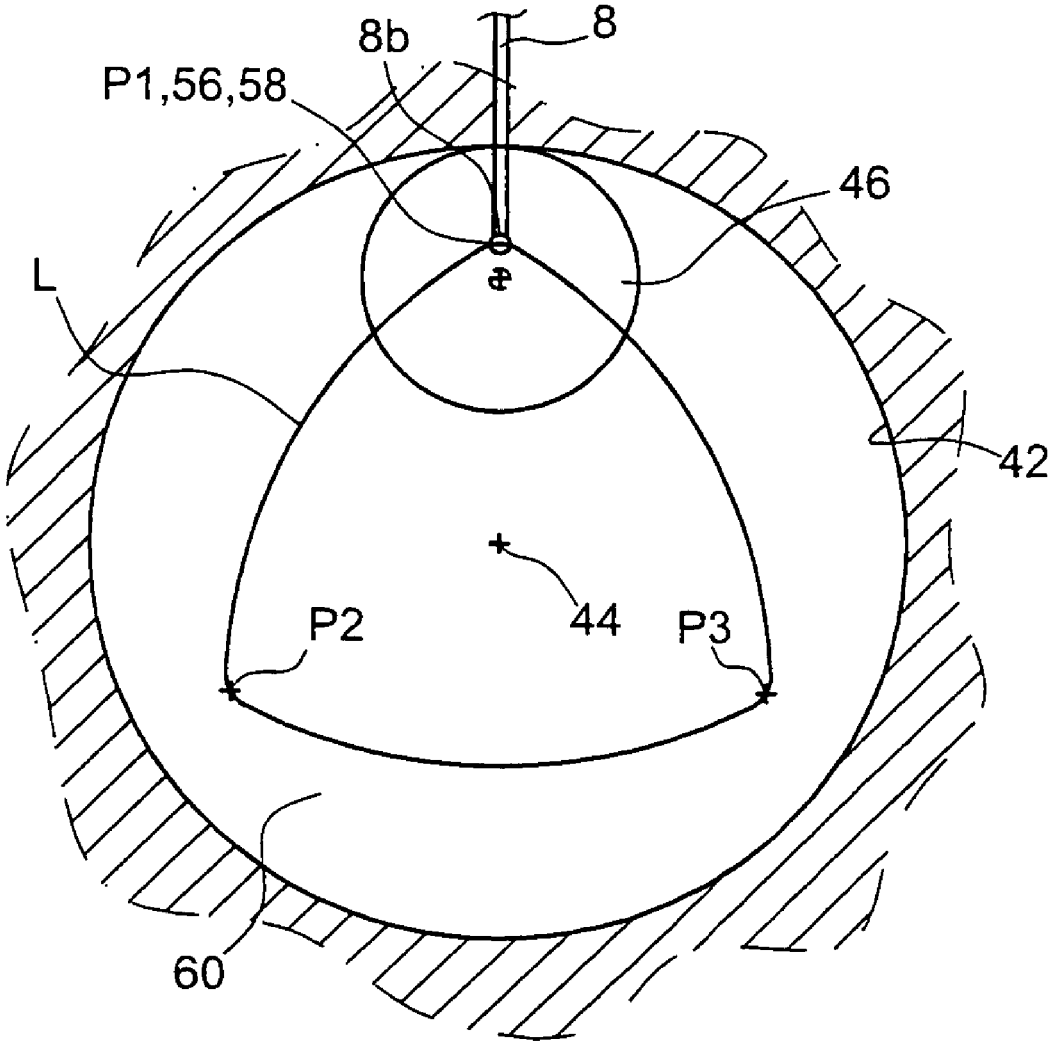

FIGS. 4*a* to 4*d* show the control device of FIG. 3 at various stages during a control cycle starting from an instant at which the moving contact is in its closed position, and continuing until said moving contact returns to the same position after having been in its open position;

FIG. 5 is a front view of a control device in a second alternative of the first preferred embodiment of the present invention;

FIGS. 6*a* and 6*b* are a front view and a side view of a control device in a first alternative of a second preferred embodiment of the present invention;

FIG. 7 diagrammatically shows the closed line along which the second connection point of the actuating arm moves during the cycle of putting in motion the arm belonging to the device shown in FIGS. 6*a* and 6*b;*

Figure 7A:
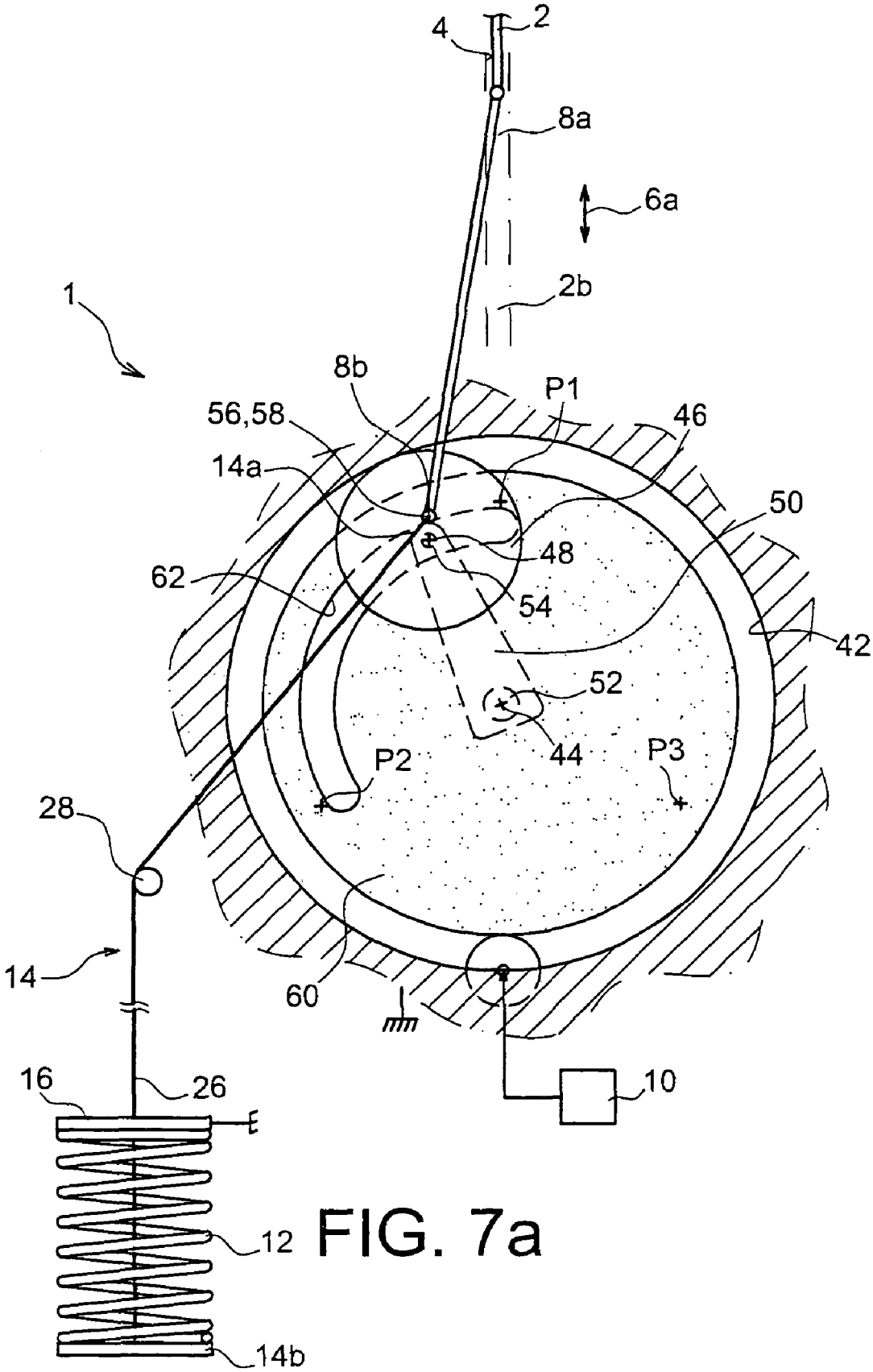
Figure 7B:
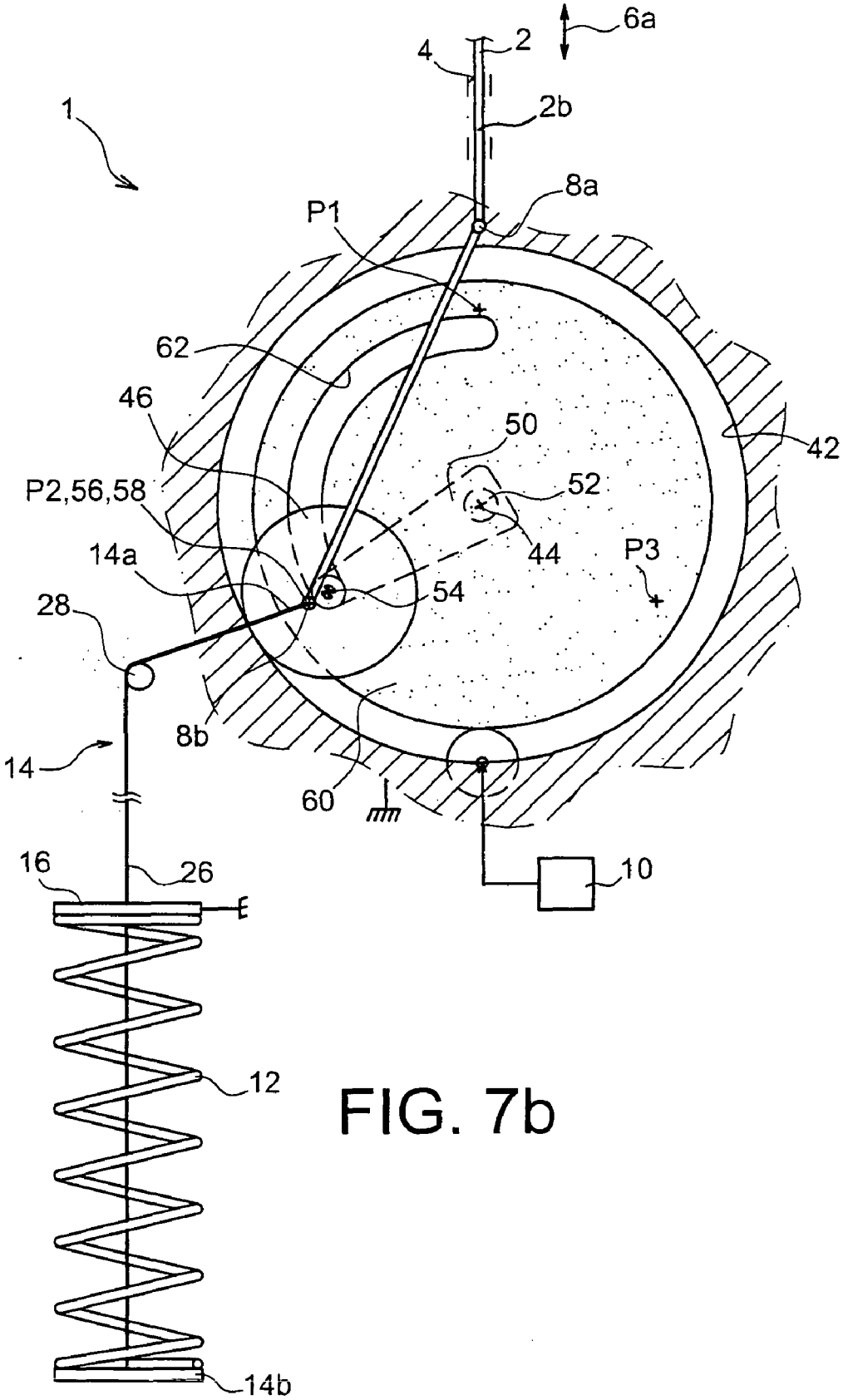
Figure 7C:
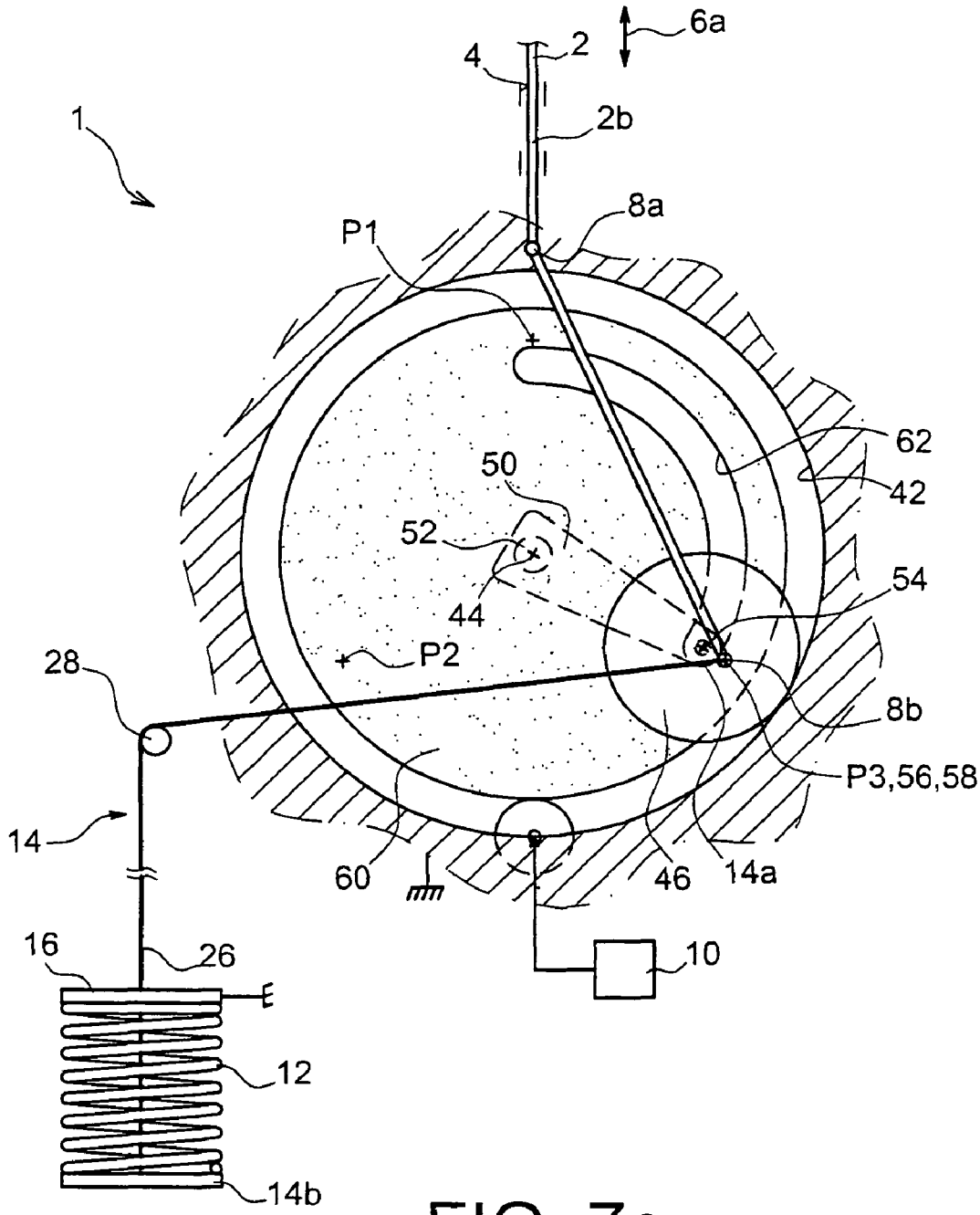
Figure 8A:
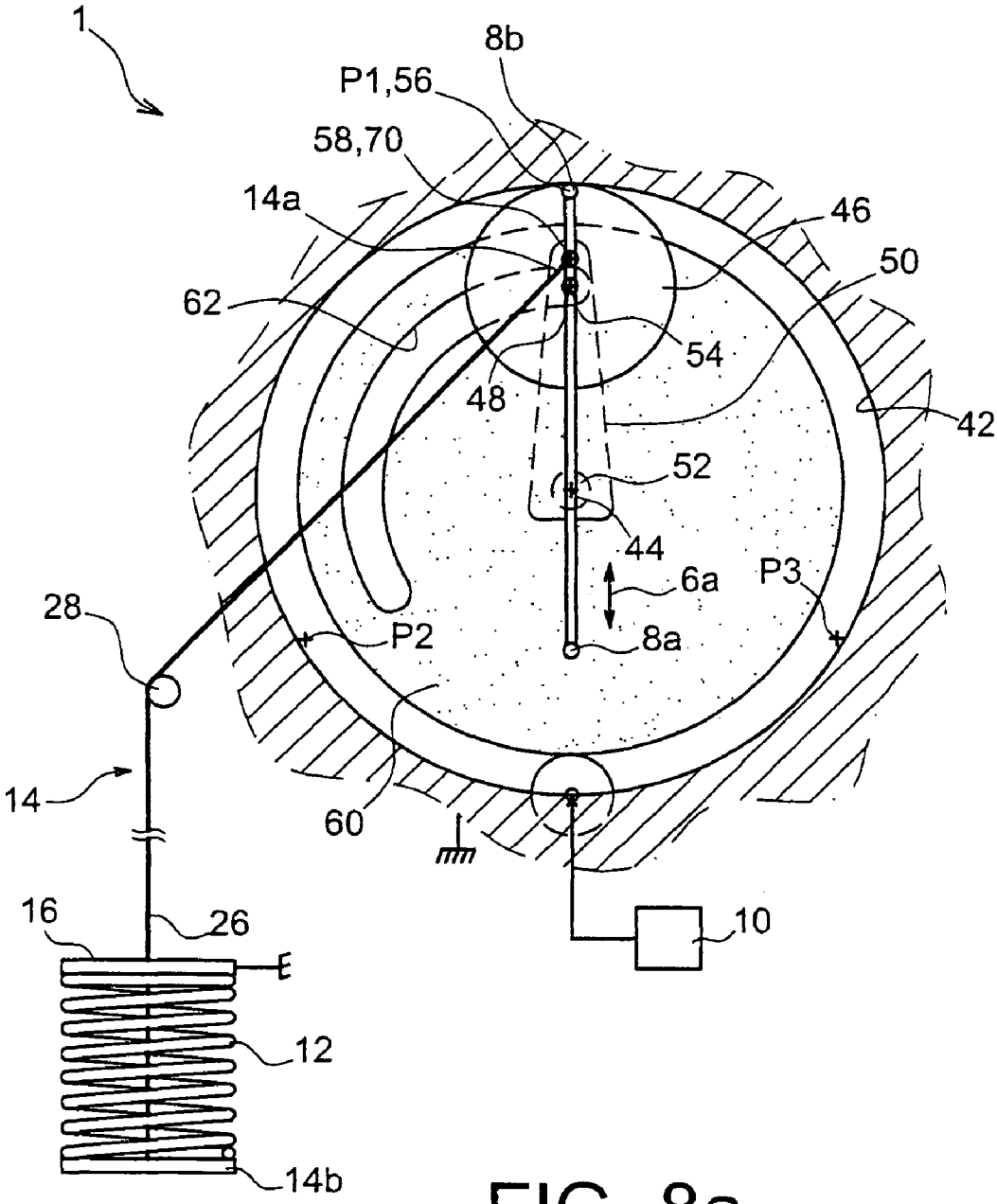
Figure 8B:
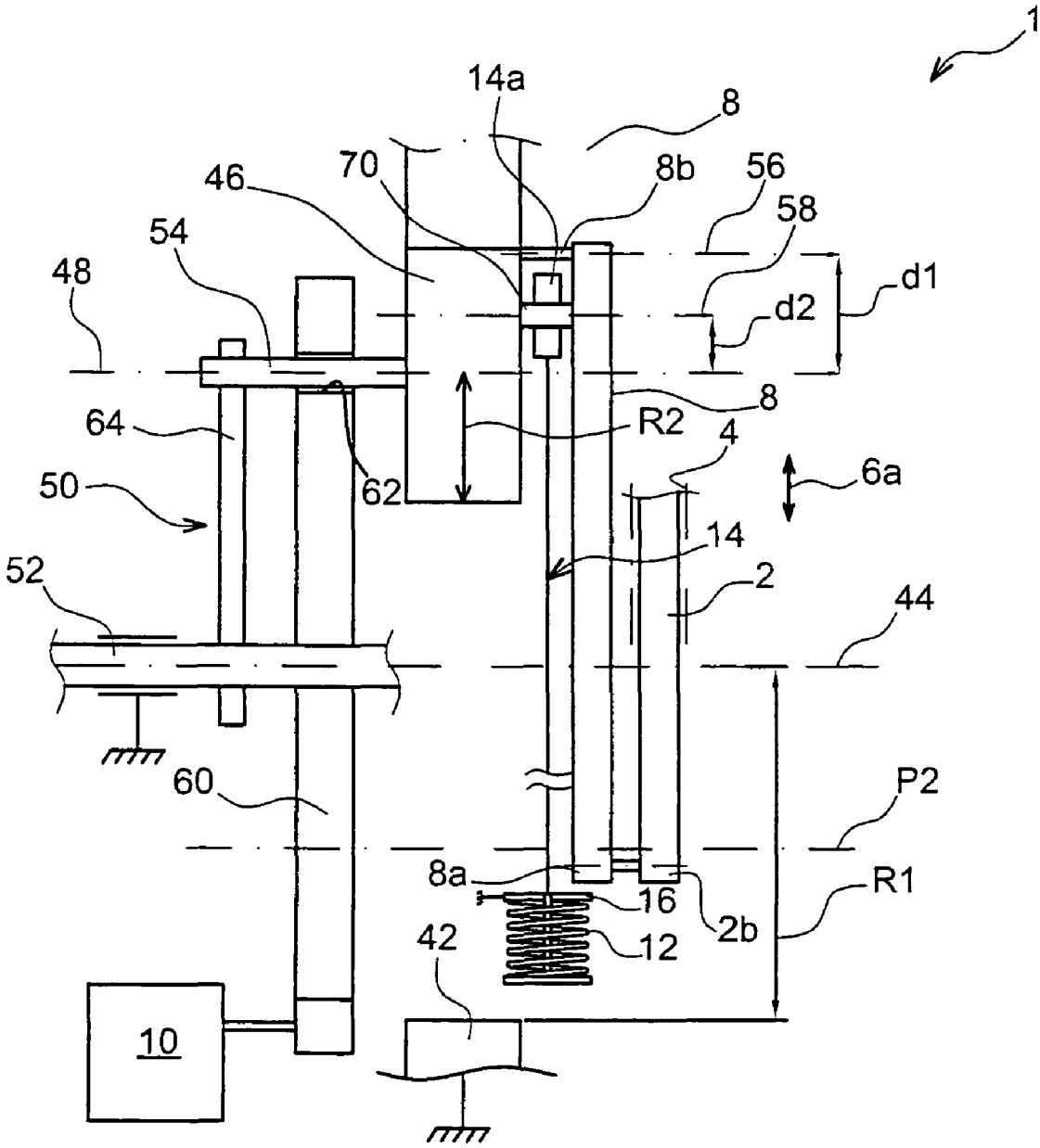
Figure 9:
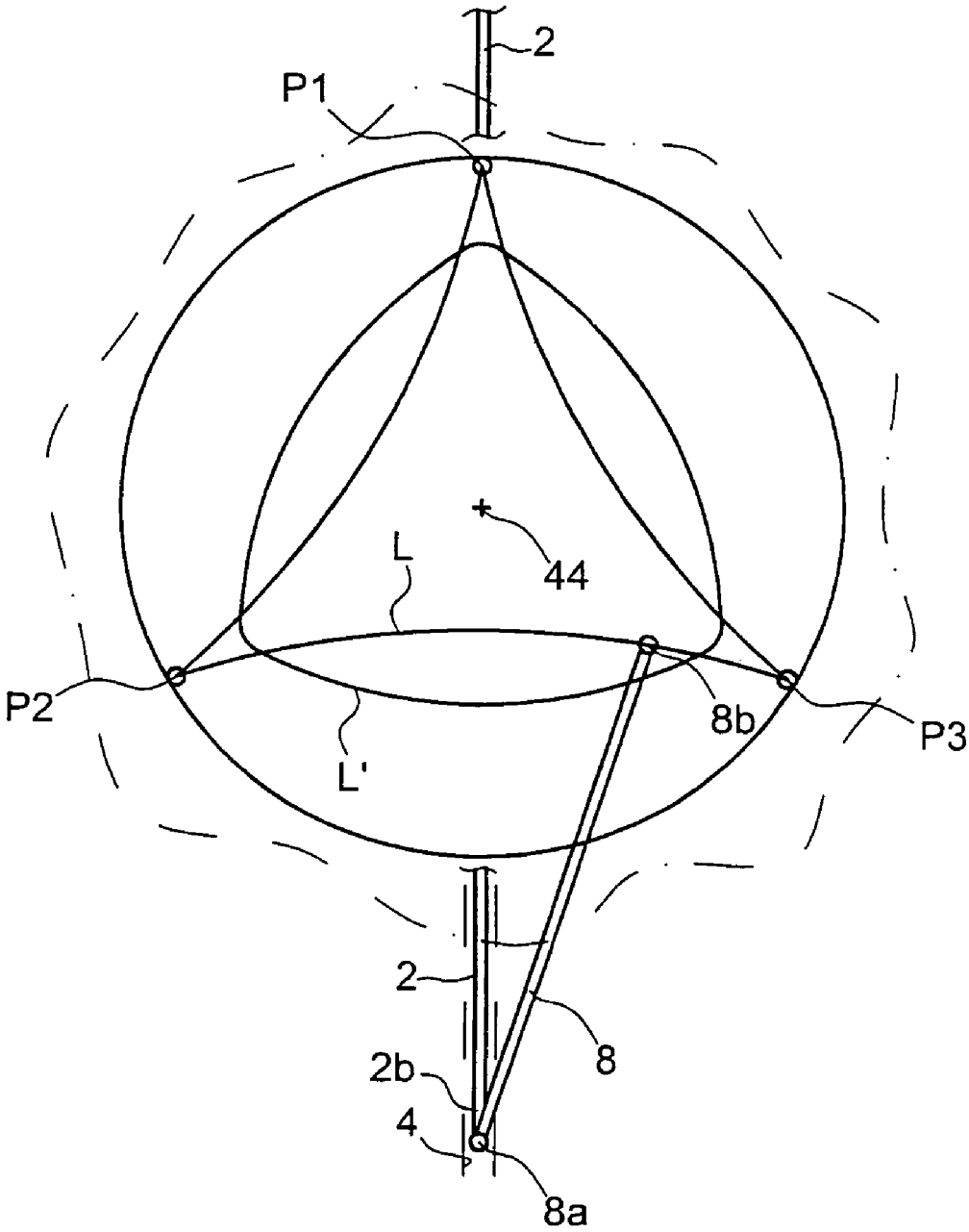

FIGS. 7*a* to 7*c* show the control device of FIGS. 6*a* and 6*b* at different stages during a control cycle starting from an instant at which the moving contact is in its closed position, and continuing until said moving contact returns to the same position after having been in its open position;

FIGS. 8*a* and 8*b* are a front view and a side view of a control device in a second alternative of the second preferred embodiment of the present invention;

FIG. 9 diagrammatically shows the closed line along which the second connection point moves during the cycle of putting in motion the arm belonging to the device shown in FIGS. 8*a* and 8*b;*

Figure 10:
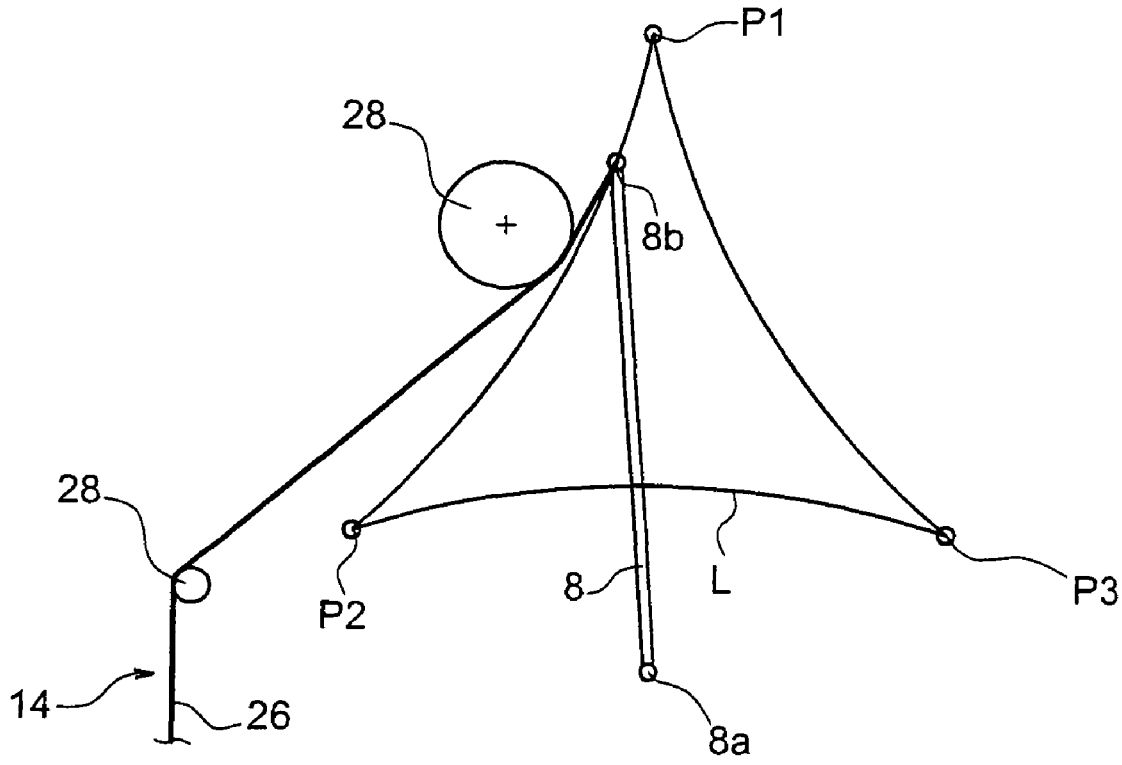
Figure 11A:
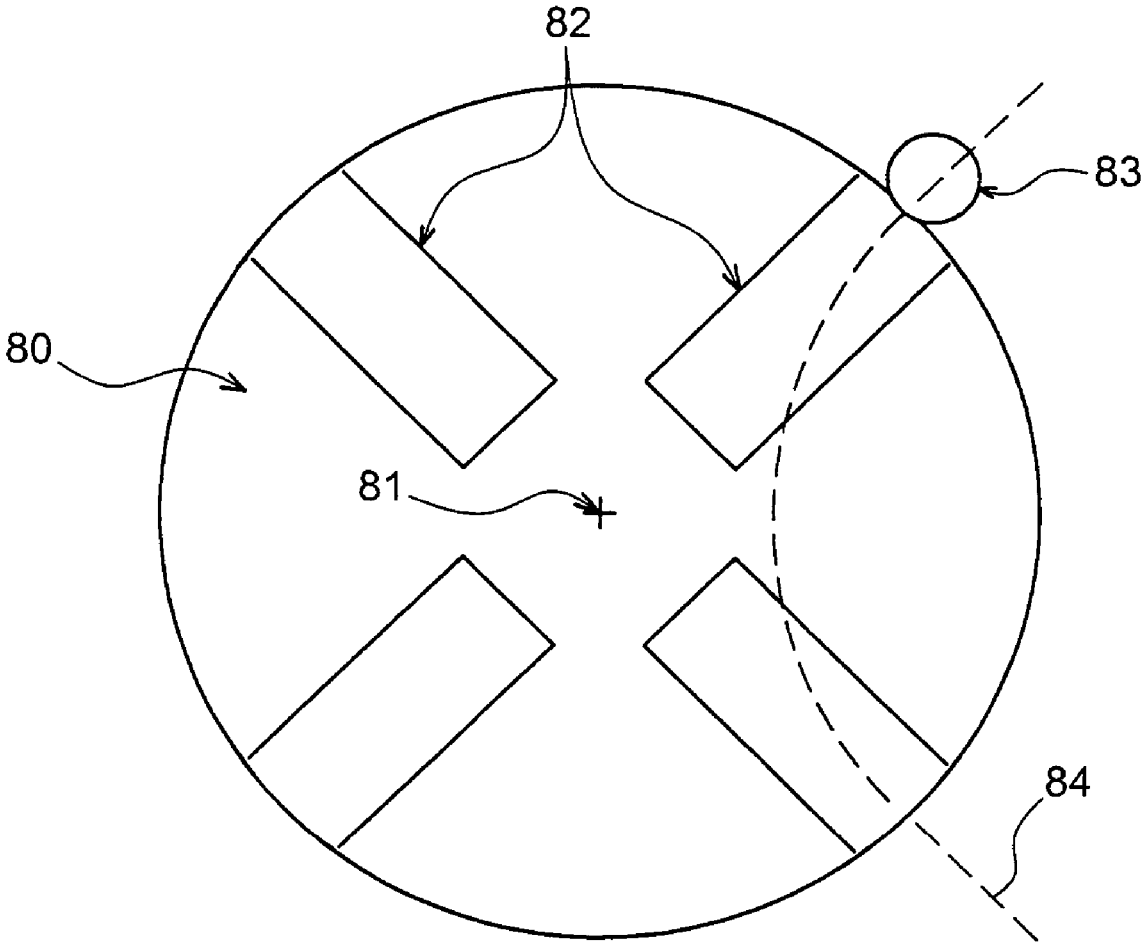
Figure 11B:
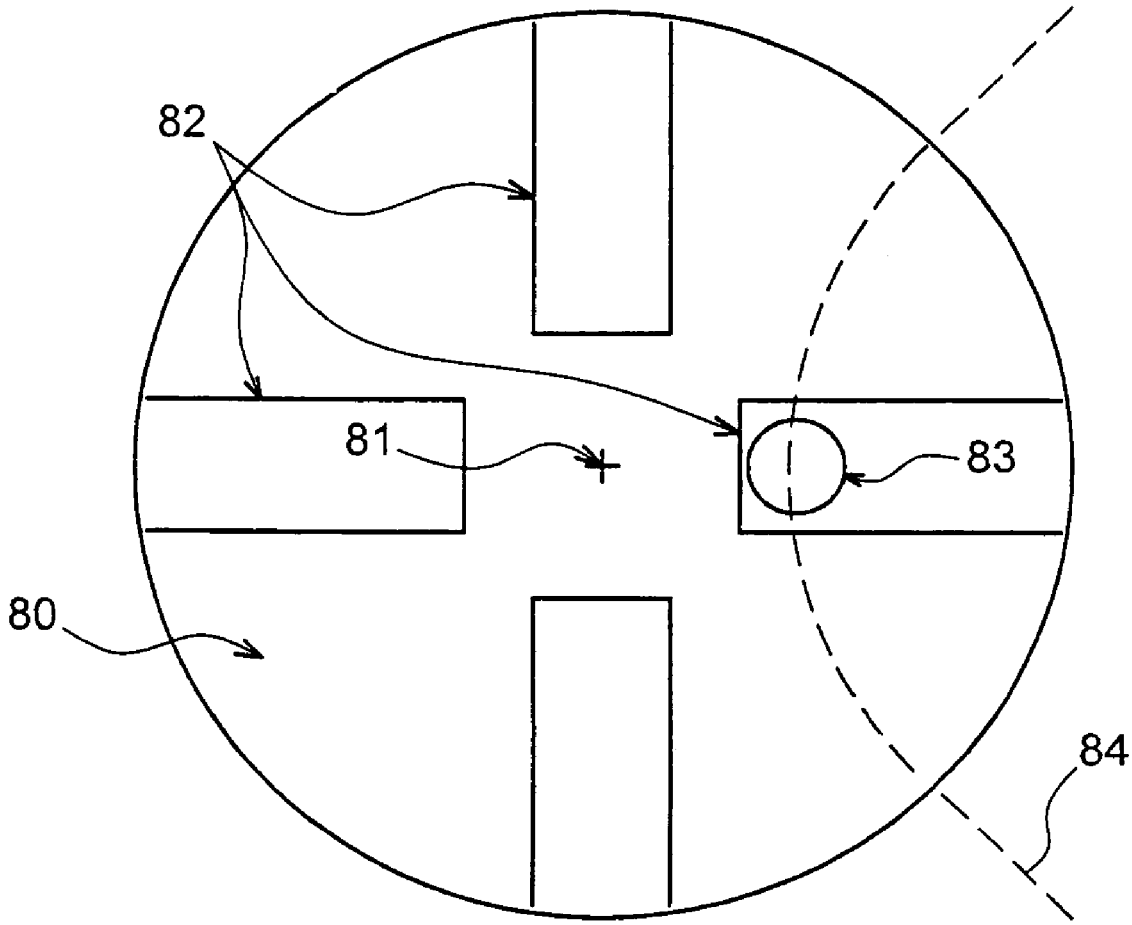
Figure 11C:
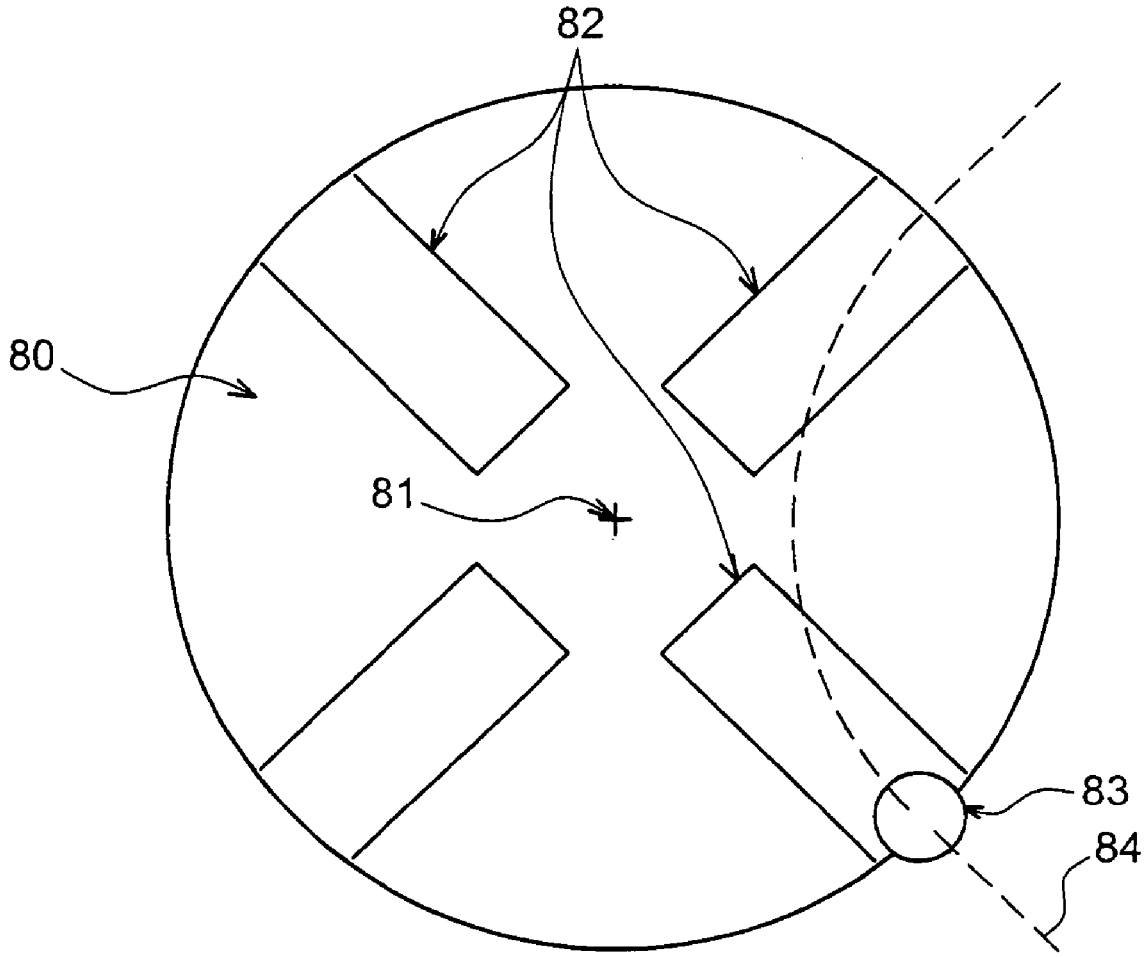

FIG. 10 is a view similar to the view of FIG. 9, and in which a preferred manner of implementing the transmission means is shown in detail; and FIGS. 11*a* to 11*c* show a manner of implementing the means making it possible to accumulate surplus energy given off during the moving contact opening stage under the effect of the mechanical spring.

Figure 1A:
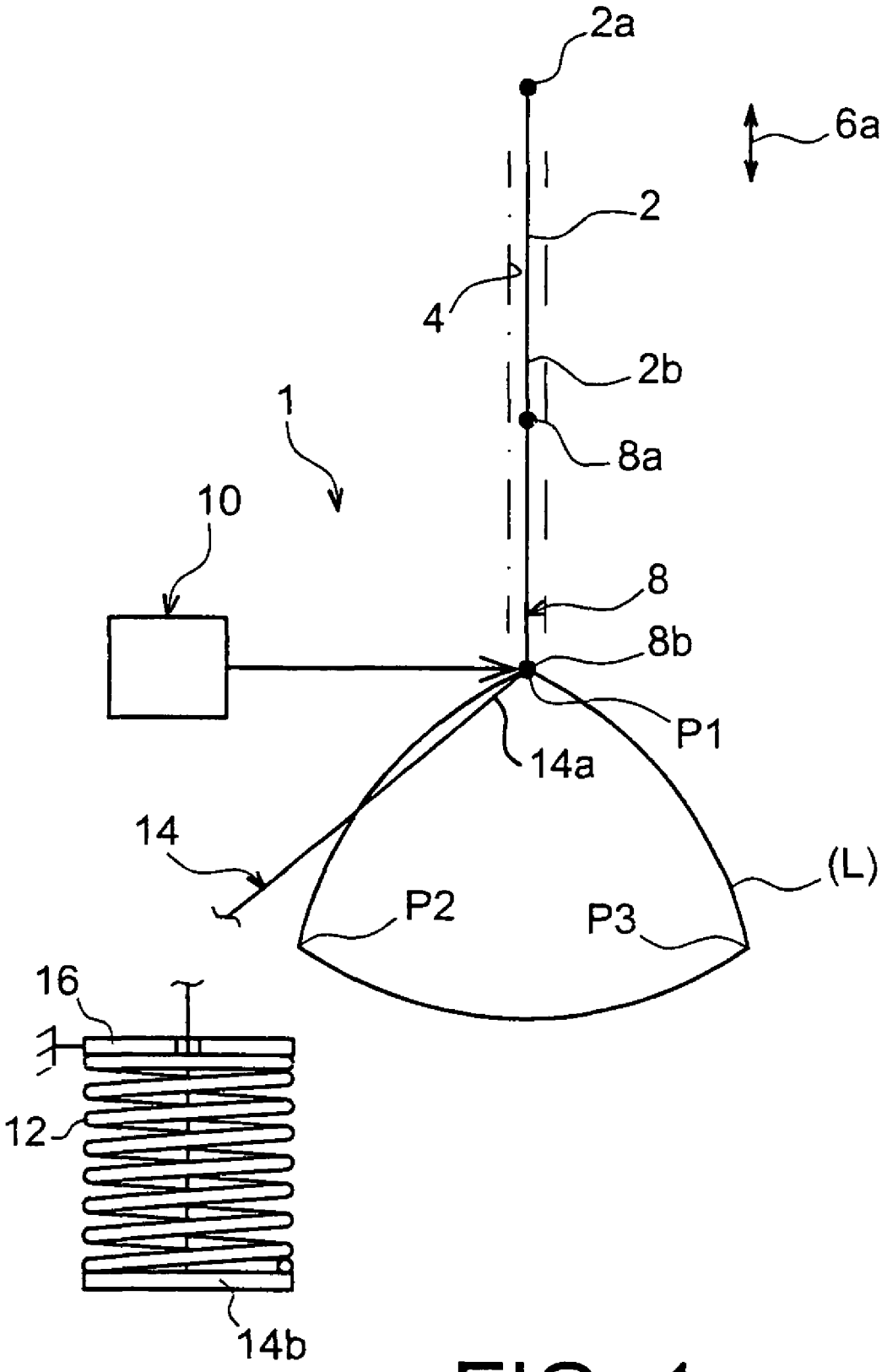
Figure 1B:
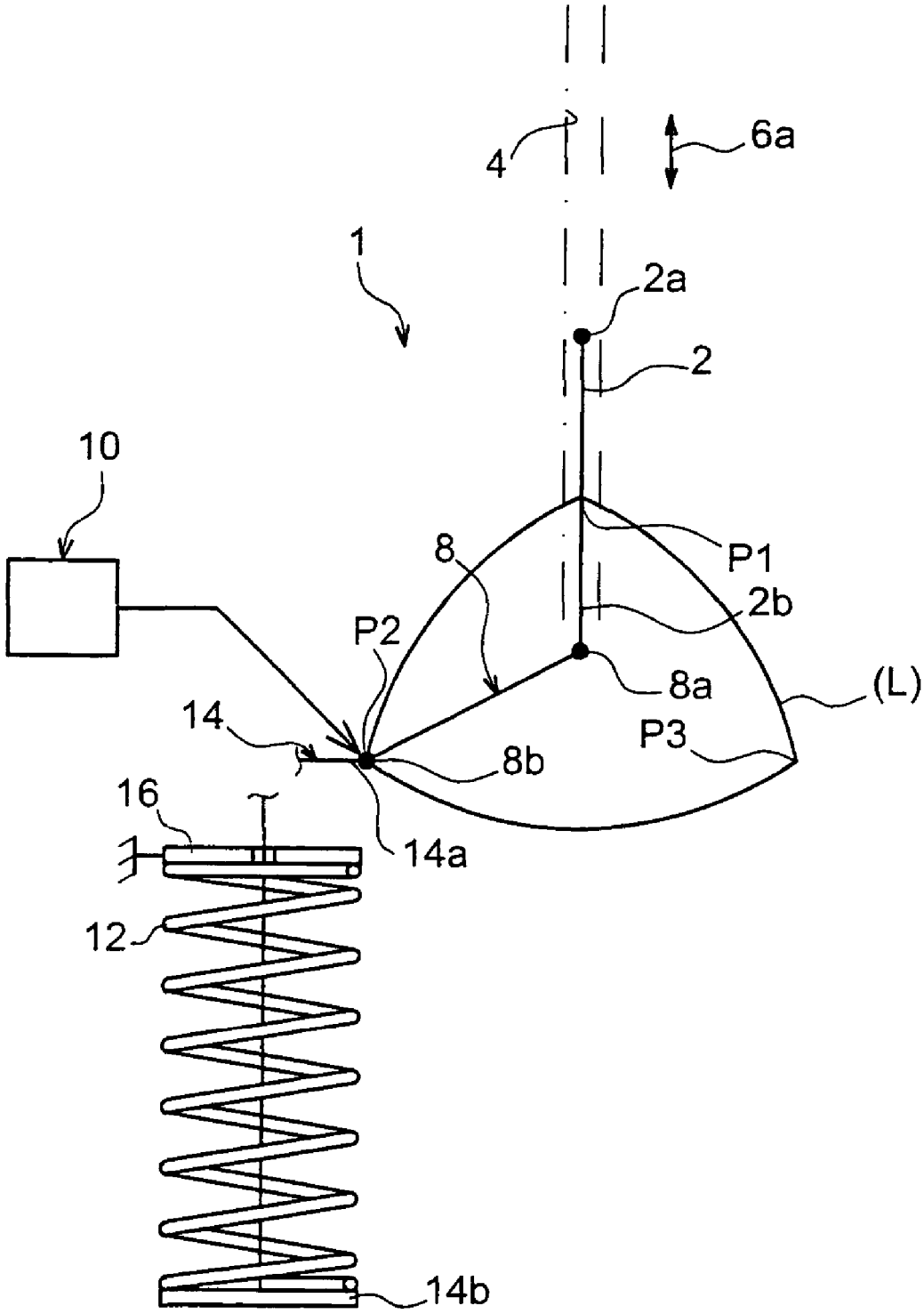
Figure 1C:
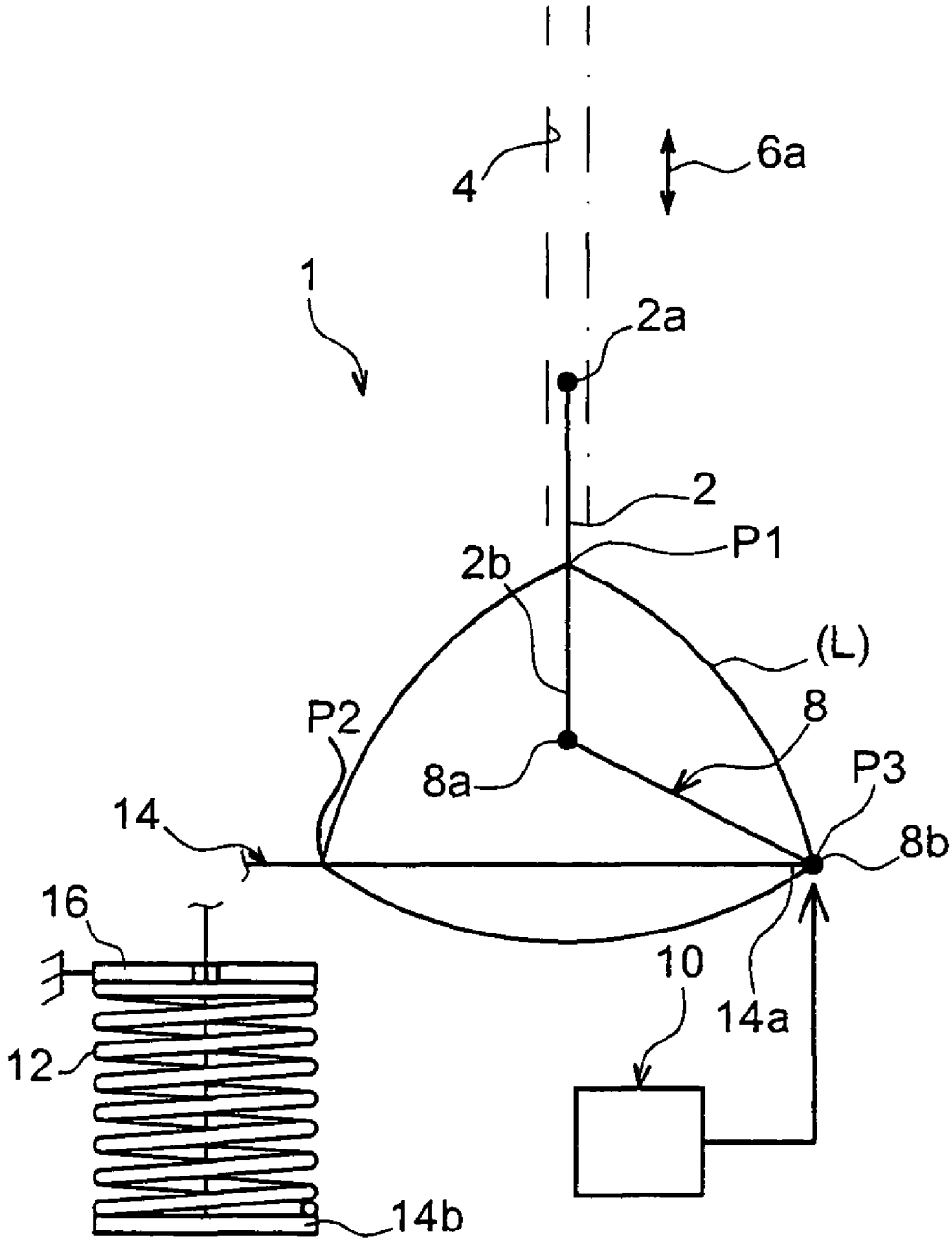

With reference firstly to FIGS. 1*a* to 1*c* which diagrammatically show the principle of the invention, it is possible to see, very diagrammatically, a control device 1 at various stages during a control cycle starting from an instant at which the moving contact (not shown) that it is intended to drive, is in its closed position, and continuing until said moving contact returns the same position after having been in its open position. FIG. 1*a* thus shows both the initial position and the final position of the cycle, the figures then following on cyclically in the order 1*a*, 1*b*, 1*c*, 1*a*, etc.

The control device 1 is designed to equip electrical switchgear having a moving contact suitable for occupying a closed position and an open position, such as, for example, a circuit-breaker, a disconnector, or indeed a grounding device. It is noted that the present invention also extends to said switchgear.

In order to perform its function of controlling the moving contact, the device 1 firstly includes an output member 2, e.g. in the form of a bar, serving to slide along its own axis along a bar path 4. Said member 2 has a connection end 2*a* for connection to the moving contact, and a connection end 2*b* for connection to an actuating arm. It can thus be noted that the end 2*a*, which can be connected directly or indirectly to the moving contact of the switchgear, is thus capable of being driven in a reciprocating movement along the axis of the member 2, thereby enabling it to deliver a linear output movement to the moving contact, as represented diagrammatically by the double-headed arrow 6*a*.

As mentioned above, the device 1 includes an actuating arm 8 having a first connection point 8*a* mounted in hinged manner on the end 2*b* of the member 2, and a second connection point 8*b* that offers the feature of being movable along a closed line L shown in FIGS. 1*a* to 1*c*. The first point 8*a* is thus also suitable for being driven in a reciprocating movement along the axis of the member 2 during the cycle of putting the arm 8 in motion, because said point is connected directly to the end 2*b* of the slidably mounted member 2.

The two preferred embodiments which are described below give possible solutions for following a closed line to the second connection point. However, these solutions are naturally not limiting.

The device 1 also includes a motor 10 of the servomotor type, a mechanical spring 12 which can optionally be replaced by a plurality of springs, and transmission means 14 interposed between the spring 12 and the actuating arm 8. More precisely, the transmission means 14 (e.g. of the following types: chain; cable; strap; belt; cog belt; linkage made up of hinged links; tape; cord; bundle of fibers; etc.) have a first end 14*a* mounted in hinged manner on the second connection point 8*b*, and a second end 14*b* co-operating with one end of the spring 12.

In the preferred example shown in FIG. 1*a* to 1*c*, the spring 12 is a spring operating in compression, with one end pressed against a stationary element 16 of the device 1, and the other end pressed against the second end 14*b* of the transmission means 14, said transmission means passing successively through the element 16 and the spring 12.

With reference more specifically to FIG. 1*a*, it is possible to see that the arm 8 is in a closure position that places the member 2 that is connected directly to it in a position such that the end 2*a* of said member enables the moving contact to occupy its closed position. It is recalled that the moving contact is held firmly in said closed position by conventional locking means (not shown) that are known to the person skilled in the art. Said locking means can either be part of the control device or else part of some other portion of the electrical switchgear.

In the closure position, the arm 8 is preferably substantially parallel to the direction 6*a*, and its second connection point 8*b* occupies a point P1 of the closed line L, which is preferably arranged in one plane, and which is preferably roughly triangular in shape. Naturally, it is possible to consider embodiments in which, in the closure position, the arm 8 is inclined relative to the direction 6*a*.

In addition, also in said closure position, the mechanical spring 12 is compressed between the element 16 and the end 14*b* of the transmission means 14.

When an instruction to open the moving contact is received by the switchgear, the above-mentioned locking means for locking the moving contact are deactivated. It is noted that said locking means preferably act indirectly on the moving contact, i.e. as close as possible to where the energy is stored in order to minimize the number of parts that are subjected continuously to mechanical stresses.

After the deactivation, an opening stage for opening the moving contact is initiated, the opening stage being achieved by releasing energy from the spring 12. During this stage, the spring 12 urges the second end 14*b* of the transmission means away from the stationary element 16, said second end entraining with it the means 14 as a whole and the actuating arm 8 whose second connection point 8*b* follows the line L along a first portion thereof.

The opening stage ends when the moving contact reaches its open position, in which it is preferably held merely by the specific design and by the specific geometrical shape of the control device, and thus without the locking means being used. The arm 8 then occupies an opening position as shown in FIG. 1*b*, in which the second connection point 8*b* is positioned at a point P2 of the closed line L, which point P2 corresponds to the limit of the first portion of said line.

Preferably, for reasons of operating reliability, and in particular for reasons of availability of the electrical switchgear, said opening stage is performed under the effect of the mechanical spring 12 only, without the motor 10 being involved. The electrical switchgear used for protecting electricity transport and distribution facilities must be capable of operating even in the event of failure of auxiliary energy sources.

Then, directly after the end of the moving contact opening stage, a re-cocking stage is initiated for re-cocking the spring 12 which has just released its energy, at least in part. The re-cocking stage is performed by means of the motor 10 imparting in any manner a movement to the arm 8 so that its second connection point 8*b* moves along a second portion of the line L to a point P3 thereof, and so that its first connection point 8*a* remains in a position ensuring that the moving contact stays in its open position, as shown in FIG. 1*c*. In other words, during this re-cocking stage, the second point 8*b* moves between the points P2 and P3 of the line L, while the first point 8*a*, the member 2, and the moving contact stay substantially in the same positions.

During this re-cocking stage for re-cocking the spring 12, the transmission means 14 are entrained by the second connection point 8*b* moving, thereby urging their end 14*b* closer to the stationary element 16 and thus to cause energy to be accumulated in the spring 12 by said spring being compressed.

When an instruction to close the moving contact is received by the switchgear, the above-mentioned locking means for locking the moving contact are deactivated, and a closure stage for closing the moving contact is initiated by the device 1, by switching on the motor 10 which imparts, in any manner, a movement to the arm 8 so that the second connection point 8*b* thereof moves along a third portion of the line L, until it reaches the above-mentioned point P1.

Preferably, said stage is performed by means of the energy transmitted by the motor 10 only, no energy coming from the spring 12. Also, provision is preferably made so that, during the moving contact closure stage, the mechanical spring 12 does not accumulate any additional energy, because the preceding spring re-cocking stage has enabled the spring to accumulate sufficient energy to perform a subsequent moving contact opening stage.

As a result, during the moving contact closure stage during which the arm 8 goes from its re-cocked position shown in FIG. 1*c* to its closure position shown in FIG. 1*a*, the end 14*b* of the transmission means 14 remains stationary, thereby ensuring that the spacing between the stationary element 16 and said end 14*b* remains unchanged. Conversely, the other end 14*a* follows the movement of the second point 8*b* of the arm 8, by pivoting thereabout.

Preferably, the three above-mentioned portions of the line L roughly forming a triangle then constitute the three sides of said triangle, it therefore being possible for the points P1, P2 and P3 to be considered to be its vertices. It is noted that the shape of the three portions shown in FIGS. 1*a* to 1*c* is in no way limiting. It is noted that the point P2 could alternatively be placed between the points P2 and P3 shown in FIGS. 1*a* to 1*c*, without going beyond the ambit of the invention.

It is possible to make provision for the device 1 to include means making it possible to accumulate surplus energy given off during the moving contact opening stage performed under the effect of the mechanical spring, as described below with reference to FIGS. 11*a* to 11*c*. This thus makes it possible to transfer said surplus energy towards the mechanical spring during the re-cocking stage for re-cocking said spring, and preferably at the time at which said re-cocking stage is initiated. Therefore, said re-cocking stage for compressing the spring advantageously takes place by means of the energy transmitted by the motor and also by means of the energy transmitted by said additional means which can, for example, by in the form of a flywheel.

In addition, it is noted that even if the device is preferably designed so that the moving contact closure stage takes place without the mechanical spring releasing or accumulating energy, it is nevertheless possible to make provision for the device to be designed so that the spring performs a function of accelerating the putting in motion of the second connection point, at the time at which the moving contact closure stage is initiated, by releasing a fraction of its energy that it has accumulated previously, and that is added to the energy delivered by the motor. The spring could also perform a braking function at the end of the moving contact closure stage, by the spring being put into compression, thereby making it possible to slow down the speed of displacement of the second connection point, and the speed of displacement of the entire actuating arm as it comes into the vicinity of its closure position shown in FIG. 1*a*.

Figure 2:
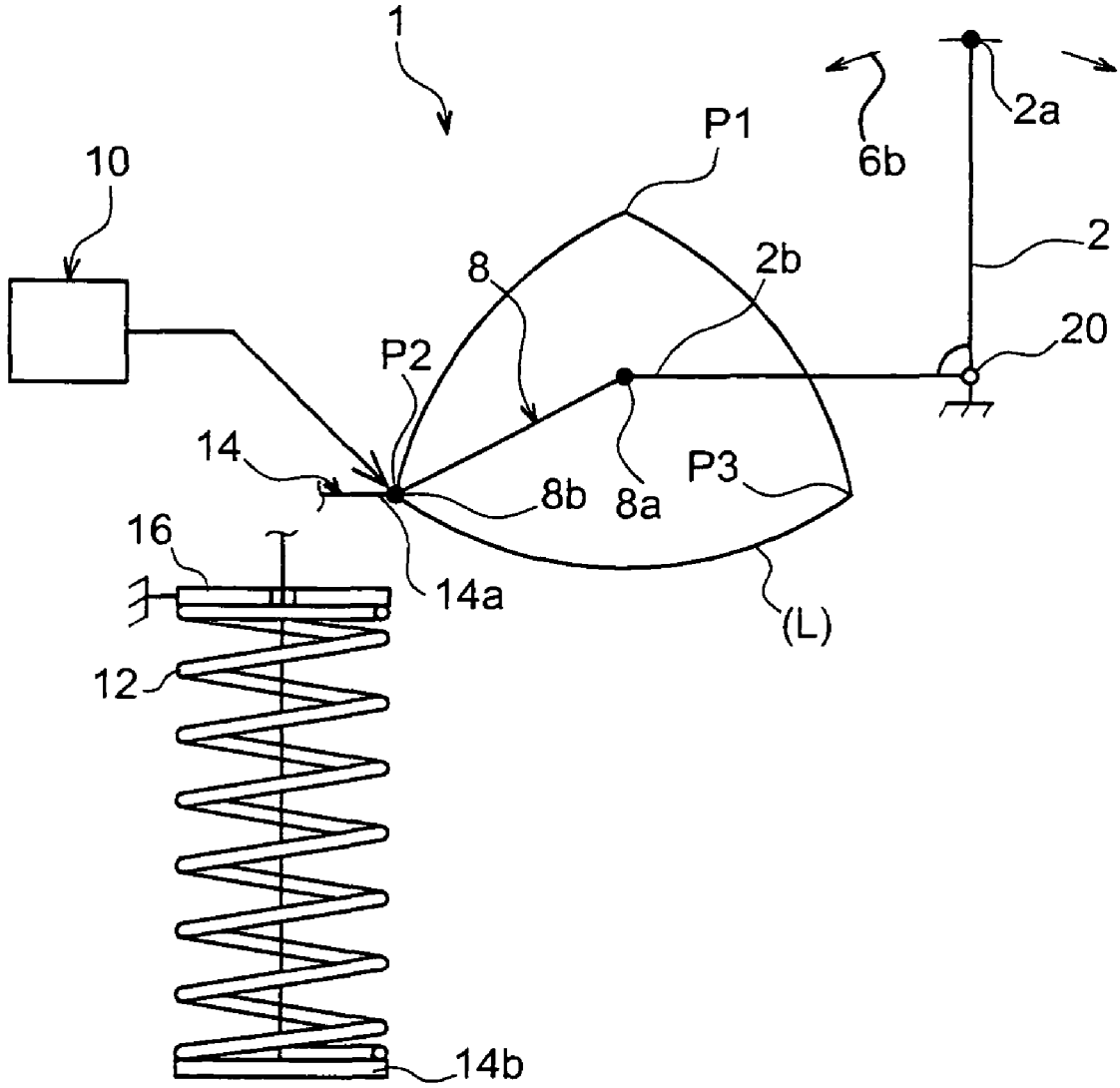
FIG. 2 is a view similar to the view shown in FIG. 1*b*, and in which the control device has been adapted to deliver a rotary output movement to the moving contact.

FIG. 2 is a diagrammatic view of the control device 1 which has been modified slightly compared with the device of FIGS. 1*a* to 1*c* so that it delivers a rotary output movement to the moving contact. This solution covered by the present invention can, for example, be obtained by replacing the slidably mounted bar with an output member 2 mounted to pivot about a stationary shaft 20, it then being possible for said output member 2 to have a first branch carrying the end 2*b* which is pivotally connected to the first connection point 8*a* of the arm 8, and a second branch that is offset angularly relative to the first branch and that carries the end 2*a* that is designed to be connected to the moving contact. In the example shown, the output member 2 is mounted on the shaft 20 at the junction between its two branches, which makes it possible to deliver a rotary output movement centered on said shaft 20 to the moving contact as represented diagrammatically by the double-headed arrow 6*b*.

Figure 4A:
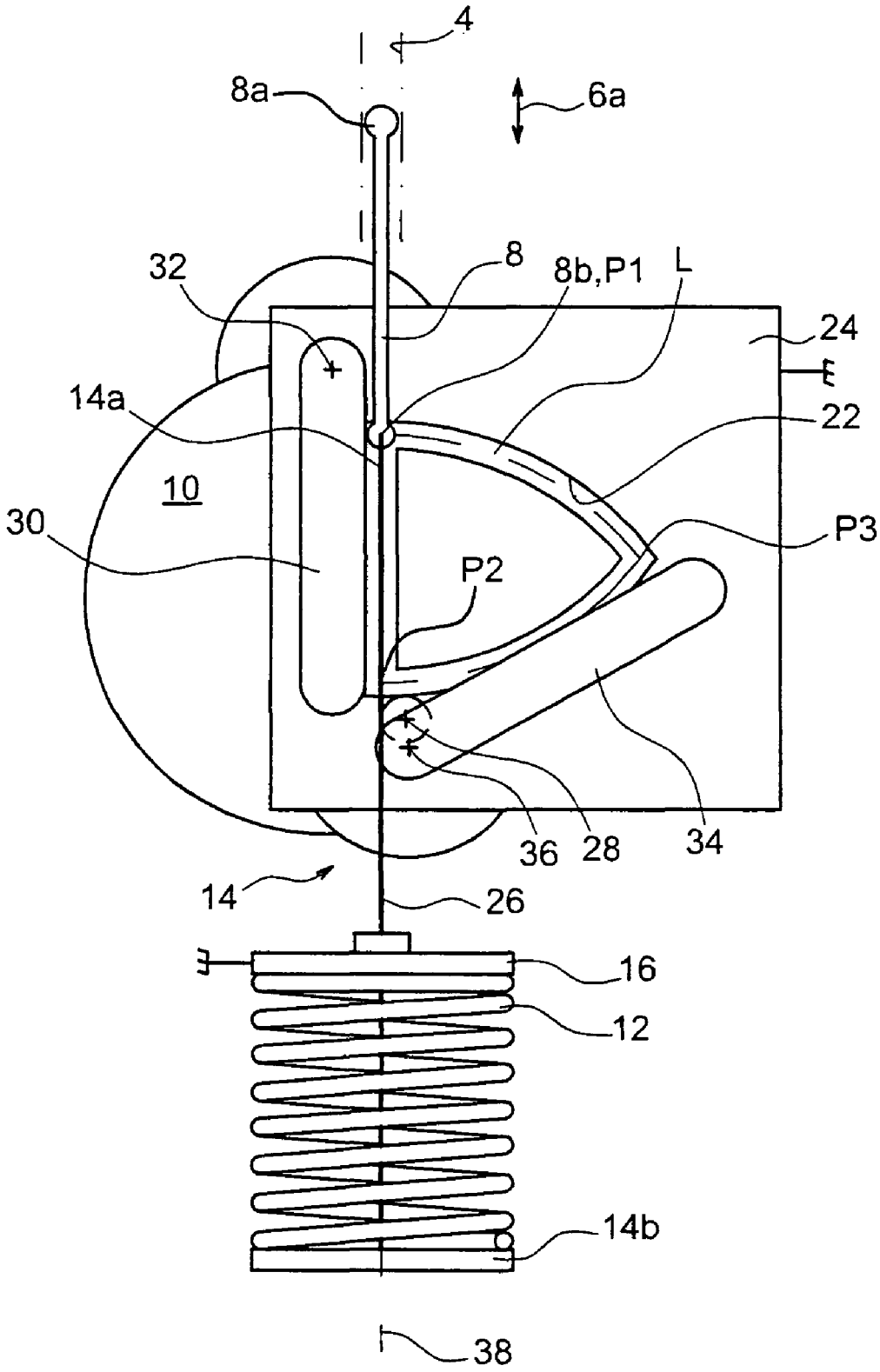

FIGS. 3 and 4*a* show a first alternative of a first preferred embodiment of the control device 1 of the present invention, FIG. 3 showing the actuating arm 8 in an intermediate position between its closure position and its opening position, and FIG. 4*a* showing the actuating arm 8 in its closure position.

In this first preferred embodiment, one of the features lies in the fact that the second connection point 8*b* of the actuating arm is constituted by a finger suitable for sliding in a groove 22 following the closed line L and provided in the stationary body 24 of the device 1, said stationary body being in the form of a plate, for example. It is noted that this first embodiment belongs to a group of possible solutions in which the actuating arm 8 is constituted by a finger guided by a path that is defined physically on a stationary body and that follows the closed line, the path thus being defined by the groove in this example, but it being possible, alternatively, for it to be defined structurally by guides on one side or on both sides, or by any other similar means.

The finger 8*b* thus passes through the groove 22, while being arranged orthogonally relative to a plane defined thereby, and it is preferably situated at one of the ends of the actuating arm 8. Therefore, as can be seen more clearly in FIG. 3, the finger 8*b* is orthogonal to the plane in which the line L lies. The groove 22 is either designed to pass through the plate 24, or else to pass out through only one of the two surfaces of said plate.

In addition, in this example, the transmission means 14 are formed by a cable 26 or the like, one end 14*a* of which is pivotally mounted on the finger 8*b*, while its other end (not referenced) carries the end 14*b* of the means 14 that bears against the moving end of the spring 12. Furthermore, the means 14 also preferably have at least one wheel 28 (visible in FIG. 4*a*) appropriately positioned so as to enable the cable 26 to be kept under tension continuously under the effect of the spring 12. The presence of said wheel(s) 28 is not always necessary for continuously tensioning the cable 26, but it makes it possible to guide said cable so that the spring and the motor that are used are as small as possible, for a given type of electrical switchgear.

Another feature of this first preferred embodiment is that the device 1 has control levers driven by the motor 10 and designed to come into contact with the finger 8*b* so as to be capable of moving it from point P2 to point P3, and from point P3 to point P1.

The device 1 has a first control lever 30 driven by the motor 10 and capable of being caused to pivot about an axis 32 parallel to the finger 8*b*, by means of a gear system (not shown) uniting it to an output of the motor. As described below, the first lever 30 is designed to perform the re-cocking stage for re-cocking the spring 12.

In the same way, the device 1 has a second control lever 34 driven by the motor 10 and capable of being caused to pivot about an axis 36 parallel to the finger 8*b*, by means of a gear system (not shown) uniting it to the output of the motor. Also as described below, the second lever 34 is designed to perform the closure stage for closing the moving contact.

Thus, it can be understood that this solution makes it possible to put both of the levers 30, 34 in motion simultaneously during the re-cocking stages for re-cocking the mechanical spring and for closing the moving contact. The levers 30, 34 are thus capable of moving synchronously so as to guarantee that they are in the correct positions during each operating cycle. However, it is noted that drive means could be used that guarantee that the levers 30 and 34 move asynchronously.

With reference more specifically to FIG. 4*a*, it can be seen that the first portion of the line L that is situated between the points P1 and P2 is rectilinear, and preferably parallel to the direction 6*a*.

In addition, the other two portions that are situated respectively between P2 and P3 and between P3 and P1 are preferably convex in shape, and each of them can constitute an arc of a circle.

When the finger 8*b* is situated at P1 as shown in FIG. 4*a*, the actuating arm 8 finds itself in the closure position in which it is parallel to the direction 6*a*. It is also possible to see that the actuating arm 8, the cable 26, and the axis 38 of the mechanical spring 12 are aligned in a direction defined by the points P1 and P2. Therefore, throughout the entire moving contact opening stage performed by releasing energy from the spring 12, the above-mentioned alignment is kept, thereby, in particular, making it possible to reach the required speeds with a spring force that it as small as possible. In the non-limiting preferred example shown in FIGS. 4*a* to 4*d*, the wheel 28 has almost no effect during the opening stage, since the two segments of cable extending on either side of it remain substantially in alignment. In alternative manner (not shown), implemented, for example, when the axis 38 of the spring 12 is not aligned with the direction defined by P1 and P2, the above-mentioned alignment could concern only the actuating arm 8 and that portion of the cable 26 which is situated between the end 14*a* and the wheel 28, preferably also in said direction defined by P1 and P2.

Figure 4B:
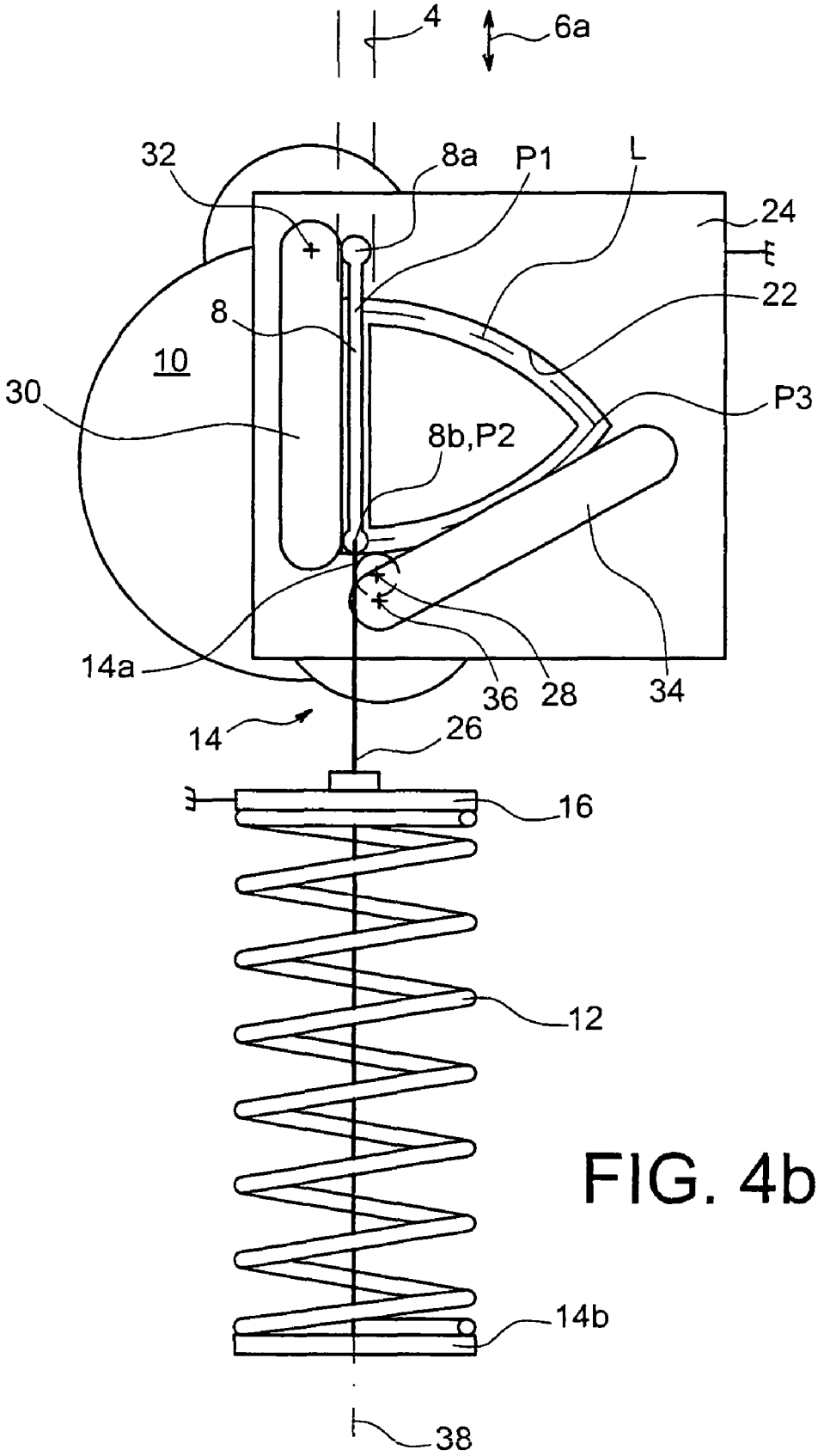

FIG. 4*b* shows the control device once the opening stage is completed, i.e. when once the arm 8 has reached its opening position in which its finger 8*b* occupies the point P2 of the closed line L which is roughly triangular in shape. It can be seen that, at the end of this stage, the actuating arm 8, the cable 26, and the axis 38 of the mechanical spring 12 are still aligned in the direction defined by the points P1 and P2.

Figure 4C:
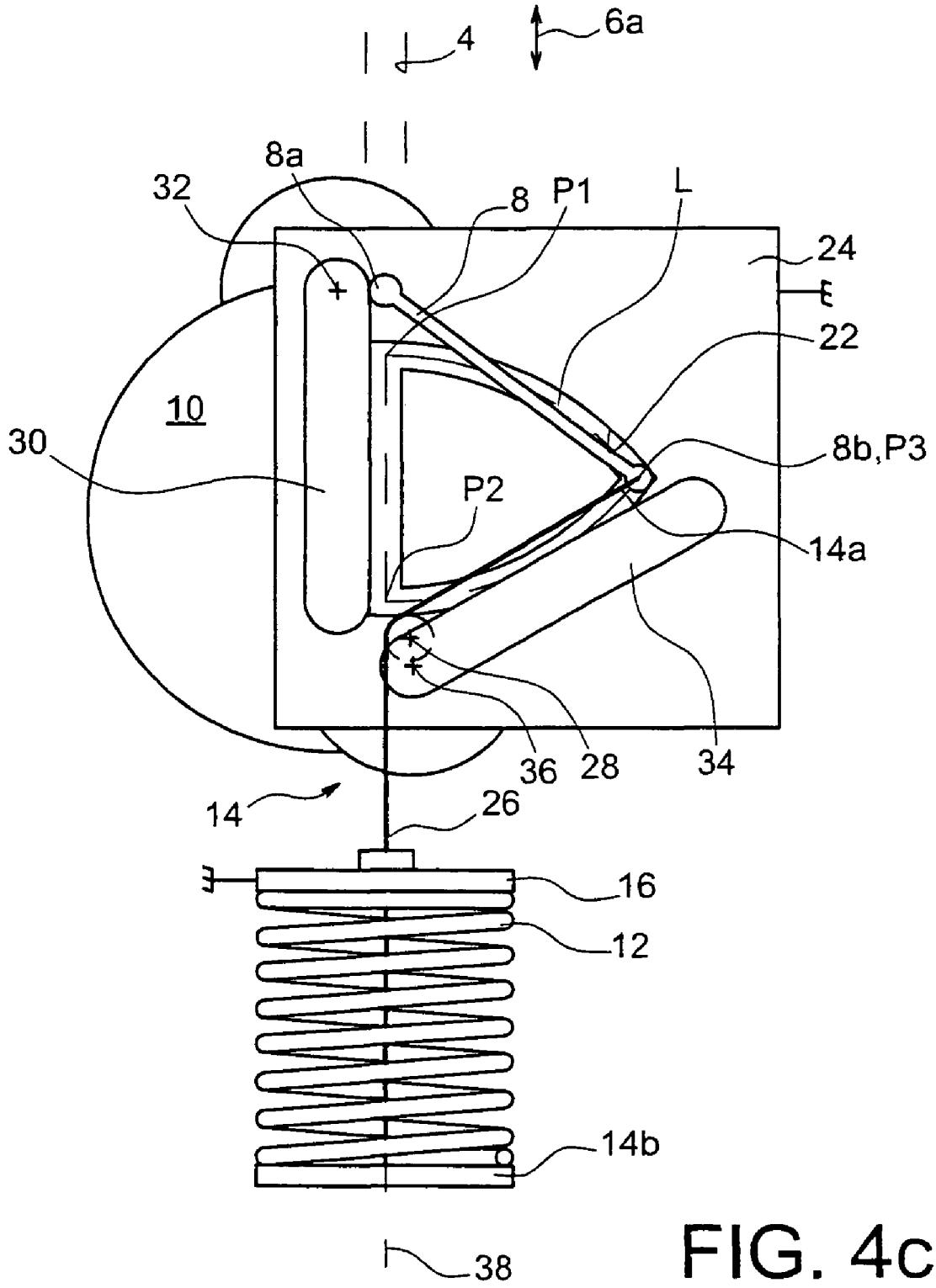

Then, directly after completion of the moving contact opening stage, a re-cocking stage is initiated for re-cocking the spring 12 that has previously had a portion of its energy released. This re-cocking stage is performed by switching on the motor 10, thereby causing the first control lever 30 to pivot until it comes into contact with the finger 8*b*, and until it pushes said finger until it reaches the point P3 of the line L by sliding along the groove 22. Once the re-cocking phase has been completed, the levers 30, 34 are returned to the original positions, as shown in FIG. 4*c*. In FIG. 4*c* it is possible to see that the spring 12 has indeed been re-compressed, and that the first connection point 8*a* has not been displaced relative to the position it occupied when the arm 8 was resting in its opening position shown in 4*b*. Naturally, this makes it possible to keep the moving contact in the open position throughout the entire spring re-cocking stage.

Figure 4D:
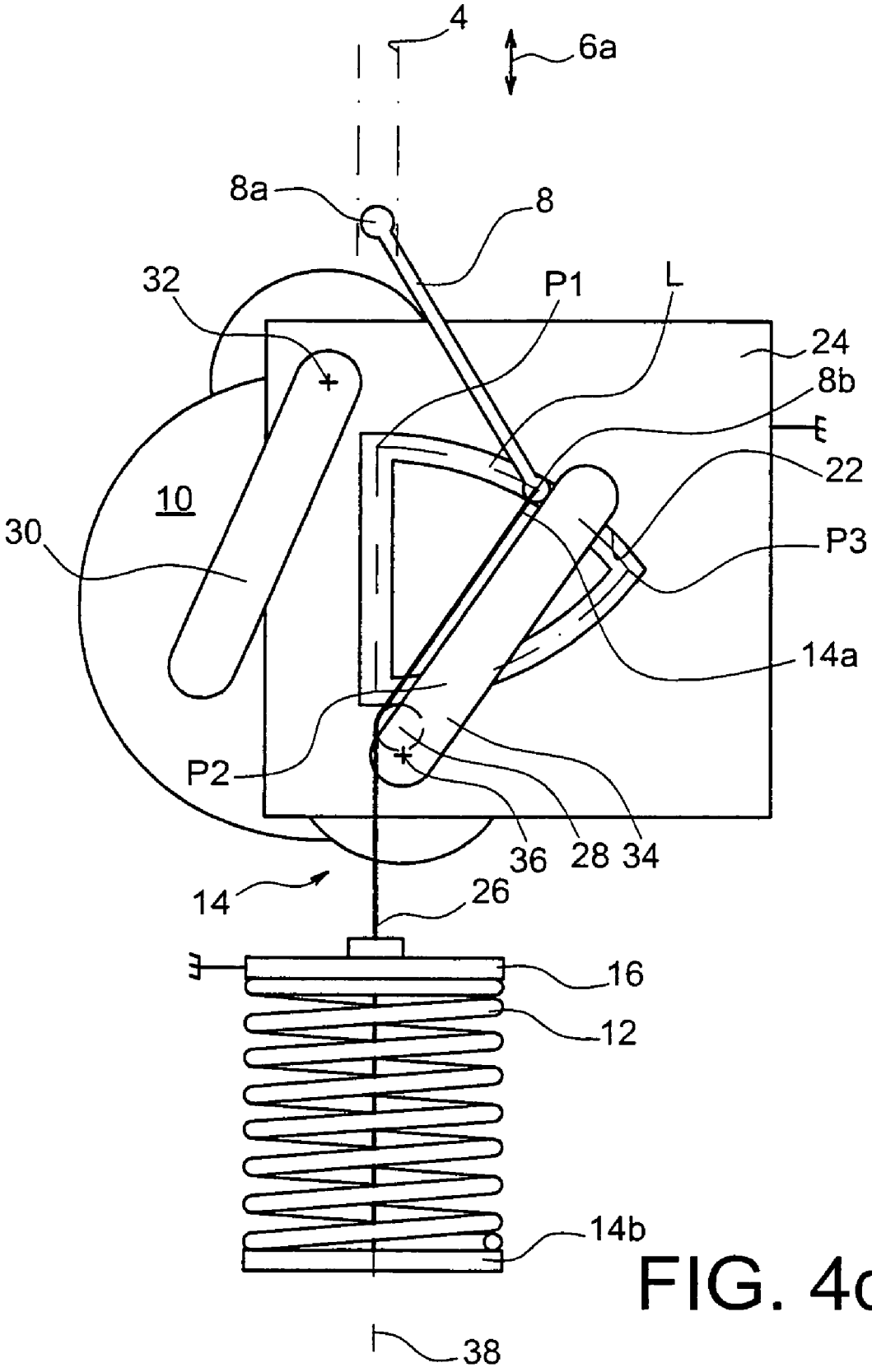

When, subsequently to said re-cocking stage, the switchgear receives a closure instruction, a moving contact closure stage is initiated, which stage is performed by switching on the motor 10, thereby causing the second control lever 34 to pivot so that it comes into contact with the finger 8*b* situated at P3 and so that it pushes said finger until said finger reaches the point P1 of the line L by sliding in the groove 22, as shown in FIG. 4*d*. Here too, when the closure stage has been completed, the levers 30, 34, which are designed to move parallel to the plate 24 and to the closed line L, are returned to their original positions as shown in FIG. 4*a*. In FIG. 4*a*, it can be seen that the spring 12 has remained in the same state of compression as the state of compression it takes up at the end of the re-cocking stage, as shown in FIG. 4*c*.

FIG. 5 is view of a second alternative of the first preferred embodiment of the control device 1 of the present invention, showing the actuating arm 8 in its closure position, after the second control lever 34 as driven by the motor (not shown) has brought, by contact, the finger 8*b* to the point P1 of the closed line L, along the groove 22.

In this second alternative, in addition to the fact that the transmission means 14 shown have a second wheel 28 close to P1 and also tensioning the cable 26, it can be seen that the first portion of the line L between the points P1 and P2 takes the form of a portion that is concave at least in part in this example. Said first portion starts from P1 with a substantially rectilinear zone, and then continues with a concave zone to the point P2. The rectilinear zone is preferably aligned with the arm 8 situated in its closure position, as shown in FIG. 5. In addition, the second wheel 28 is placed in a manner such as to ensure that the rectilinear zone and the portion of the cable 26 that is situated between the end 14*a* and said second wheel 28 are co-linear during the moving contact opening stage. In this way, at the beginning of the opening stage, said wheel 28 advantageously makes it possible for the portion of the cable 26 that is connected to the finger 8*b* to be kept parallel to the path of said finger. The speeds of displacement required for the moving contact are therefore reached more easily.

The other wheel 28 shown in FIG. 5 and closer to the spring 12 makes it possible to put the cable 26 in the correct direction during the re-cocking stage for re-cocking the spring 12.

The other elements of the control device 1 are identical or similar to those presented in the above-description of the first alternative.

It is recalled that, in this alternative, the finger 8*b* is guided all the way along the line L in a path defined structurally by the groove 22. Although it is imagined that the path can be physically defined in full on a stationary body, it is alternatively possible to imagine, as mentioned above, that the path is defined in part otherwise than structurally on the stationary body. In which case, over the portions of path that are not defined structurally, the finger 8*b* is, for example guided along the path by means of the specific positions of the transmission means and of the associated pulleys or wheels.

By way of example, in the portion of the path that is defined above and referred to as the "rectilinear portion", i.e. the portion situated between the point P1 and the second wheel 28, it is not necessary to provide any groove since the path of the finger 8*b* is imposed by design, and by the specific positioning of the transmission means and of the second wheel 28. It is thus possible to make provision for the groove 22 to be interrupted in the above-mentioned portion, which also advantageously makes it possible to avoid any rubbing of the finger 8*b* in the groove at this particular time in the cycle when the speed of the moving contact is absolutely essential. In which case, the finger 8*b* thus exits from the groove on arriving at P1, and re-enters it after going past the second wheel 28.

It is noted that another interruption in the groove 22 could also be formed between the points P2 and P3 without going beyond the ambit of the invention.

FIGS. 6*a* and 6*b* are views of a first alternative of a second preferred embodiment of a control device 1 of the present invention, both these Figures showing the actuating arm 8 in its closure position.

In this second preferred embodiment, one of the features lies in the fact that a gear system is provided that is capable of moving the second connection point 8*b* of the actuating arm 8 along the closed line L (not shown in FIG. 6*a*, and 6*b*), so that it is then no longer necessary to provide a path that is defined structurally on a stationary plate as in the first preferred embodiment.

The gear system implements a stationary inner ring 42 of radius R1 and of central axis 44 and a planet wheel 46 of radius R2 meshing externally with said ring 42, and arranged on a central axis 48 parallel to the axis 44. In addition, the gear system also has a planet wheel holder 50 provided with a rotary shaft 52 arranged on a central axis 44, and with a shaft 54 carrying the planet wheel 46 in freely rotatable manner. Naturally, the shaft 54 is arranged on the axis 48.

Thus, provision is then made for the second connection point 8*b* to be constituted by a finger rotatably mounted on the planet wheel 46, said finger 8*b* having a central axis 56 that is parallel to the axis 48, and that is spaced apart therefrom by a distance d1.

As can be seen more clearly in FIG. 6*b*, the finger 8*b* is mounted on one of the faces of the planet wheel 46, orthogonally thereto, and naturally eccentrically. In this manner, it can be understood that the closed line L defined by the finger 8*b* when the gear system is put in motion takes the form of a hypocycloid curve defined by the following equation system, defined as a function of a parameter "t":

$$x(t)=(R1-R2)\cdot\cos(t)+d1\cdot\cos((-1+R1/R2)t)$$

$$y(t)=(R1-R2)\cdot\sin(t)-d1\cdot\sin((-1+R1/R2)t)$$

The transmission means 14 in this example are also formed by a cable 26, kept under tension throughout all of the stages of the operating cycle, and by at least one wheel 28. The end 14*a* of the cable 26 is pivotally mounted on the planet wheel 46, so that it can pivot relative thereto about a pivot axis 58 that is parallel to the central axis 48 of the planet wheel 46, and that is spaced apart from said central axis by a distance d2. As can be seen in FIG. 6*b*, in this first alternative of the second embodiment, in which the two axes 56 and 58 coincide, implying in particular that the distance d1 is equal to the distance d2, the end 14*a* can be pivotally mounted on the finger 8*b*, between the planet wheel 46 and the actuating arm 8.

The other end (not referenced) of the cable 26 carries the end 14*b* of the means 14 that bears against the moving end of the spring 12, which is also held at the other of its ends by the stationary element 16. However, it is possible to use other transmission means known to the person skilled in the art, e.g. of the following types: strap; belt; cog belt; linkage made up of hinged links; tape; cord; bundle of fibers; etc.

In this configuration, the parameters R1, R2, d1 and d2 are preferably set in a manner such that they satisfy the following condition:

$$R=3\cdot R2=9\cdot d1=9\cdot d2.$$

However, the ratio d1/R2 preferably lies in the range 0.3 to 0.4.

This makes it possible to give the closed line L followed by the finger 8*b* and by is axis 56 a shape that is roughly an equilateral triangle with rounded vertices and with slightly convex sides, as can be seen in FIG. 7. In FIG. 7, it is also possible to see that the points P1, P2 and P3 are situated at respective ones of the three above-mentioned vertices.

In addition, more particularly with reference to FIGS. 6*a* and 6*b*, another feature of said second preferred embodiment is that the gear system preferably includes a toothed wheel 60 driven by the motor 10 and mounted in freely rotatable manner on the rotary shaft 52. Said wheel 60 is designed to be coupled mechanically to the planet wheel holder 50 so as to allow said planet wheel holder to pivot freely about its shaft 52 during the opening stage for opening the moving contact, and so as to entrain said plane wheel holder 52 in rotation with it during the re-cocking stage for re-cocking the spring, and during the closure stage for closing the moving contact.

For this purpose, it is possible to make provision for the mechanical coupling to take place via a circular groove 62 provided in the wheel 60, said groove being centered on the axis 44 and being formed merely over a given angular sector of said wheel.

As can be seen in FIG. 6*b*, the groove 62 passes the shaft 54 of the planet wheel holder, which implies that the wheel 60 is preferably positioned in parallel manner between the planet wheel 46 and an arm 64 of the planet wheel holder 50 that unites the two shafts 52, 54 of said planet wheel holder.

Other types of coupling, be they mechanical or other forms of coupling, can naturally replace the above-described coupling, without going beyond the ambit of the invention.

When the finger 8*b* is situated at P1 as shown in FIG. 6*a*, the actuating arm 8 is thus in the closure position, in which it is parallel to the linear output direction 6*a* of the control device 1. In addition, it can also be seen that the axes 44, 48, 56, 58 are naturally parallel, and are situated in the same diametrical plane of the ring 42. However, it is noted that this specificity is not necessary, and that, in this configuration in which the arm 8 occupies its closure position, the axis 58 of the transmission means 14 could naturally be situated outside the plane defined by the axes 44, 48 and 56 of the planet wheel holder 50 and of the finger 8*b*.

When the switchgear receives an instruction to open the moving contact, said moving contact is released by its associated locking means, and the opening stage for opening the moving contact can then be performed by releasing energy from the spring 12.

During the opening stage, the energy released by the spring 12 causes the end 14*b* of the transmission means 14 to be put in motion, said end entraining with it the cable 26, the finger 8*b* and the shaft 54 which slides freely in the circular groove 62. It is noted that the wheel 60 remains stationary because this stage does not involve switching on the motor 10. It is specified that when it occupies the point P1, the finger 8*b* is received in the vicinity of but outside one of the two ends of the groove 62, while when it occupies the point P2, the finger 8*b* is received in the vicinity of the other of the two ends of said groove, but still outside said end.

As shown in FIG. 7*a*, during the opening stage, the planet wheel 46 turns about its central axis 48 by meshing with the ring 42, while the planet wheel holder 50 pivots about the axis 44, thereby causing the arm 8 to move towards its opening position shown in FIG. 7*b*, in which the finger 8*b* is situated at P2. During this opening stage, the shaft 54 thus moves freely in the groove 62 that is held stationary, this movement taking place from one end of the groove 62 to the other end of the groove.

Then, directly after completion of the moving contact opening stage, a re-cocking stage is initiated for re-cocking the spring 12 which has previously released at least a fraction of its energy, as shown by its length in FIG. 7*b*. This re-cocking stage is performed by switching on the motor 10, thereby causing the wheel 60 to turn until one of the ends of its circular groove 62 comes into contact with the shaft 54, and pushes said shaft until the finger 8*b* reaches the point P3 of the closed line L. As appears clearly from the figures, the end in question is not the end that is occupied by the shaft 54 at the end of the opening stage, but rather the opposite end that is occupied by said shaft 54 when the arm 8 occupies its closure position.

As shown in FIG. 7*c*, once the re-cocking stage has been completed, the spring 12 has been compressed, and the connection point 8*a* has not been displaced relative to the position it occupied when the arm 8 was resting in its opening position shown in FIG. 7*b*. This naturally makes it possible to keep the moving contact in the open position through the entire re-cocking stage for re-cocking the spring.

When, subsequently to the re-cocking stage, the switchgear receives a closure instruction, a closure stage is initiated for closing the moving contact, which stage is performed by switching on the motor 10, thereby once again causing the wheel 60 to turn so that that end of its groove 62 which is in contact with the shaft 54 pushes said shaft once again until the finger 8*b* reaches the point P1, as shown in FIG. 6*a*. In FIG. 6*a*, it can be seen that the spring 12 has remained in the same state of compression as the state of compression it takes up at the end of the re-cocking stage, as shown in FIG. 7*c* which shows the actuating arm 8 in the re-cocked position.

In a normal operating mode, i.e. in an operating mode in which all of the elements of the system are in working order, the wheel 60 is turned by the motor 10 at the same time as the opening instruction is given. Thus, the kinetic energy acquired by the wheel 60 is used again at the beginning of the re-cocking operation. However, the wheel 60 being put in motion does not participate in or does not participate very significantly in moving the axis 54 during the opening stage, so that it is possible to consider that that finger 8*b* is moved during the same stage under the action of the spring only, and not also indirectly by the wheel 60 being put in motion.

Without going beyond the ambit of the invention, the motor can, however, be used advantageously at the beginning of the opening stage as a supplement to the action from the spring 12, so as to satisfy constraints from certain applications that require the electrical switchgear to have an exceptionally short reaction time. In such a context, not using the motor results in a normal reaction time being obtained.

Also without going beyond the ambit of the invention, the motor can be used advantageously to servo-control the position, the speed, or the acceleration of the moving contact during the closure stage, to servo-control the position, the speed, or the acceleration of the moving contact during the opening stage, and/or to guarantee that the spring is re-cocked within a defined lapse of time.

In a degraded operating mode in which the servomotor 10 is not in working order, the wheel 60 is then not put in motion. The opening operation nevertheless takes place as described above, without being followed by the re-cocking stage. This procures a particular advantage in the field of operating reliability, insofar as opening can be performed even in the event of failure of the electrical auxiliaries of the switchgear.

FIGS. 8*a* and 8*b*, are views of a second alternative of the second preferred embodiment of the control device 1 of the present invention, showing the actuating arm 8 in its closure position.

In this second alternative, it is possible to see two essential differences relative to the first alternative, the first lying in the fact that the pivot axis 58 of the transmission means 14 and the central axis 56 of the finger 8*b* no longer coincide, but rather they are distinct from each other. Thus, the end 14*a* is no longer pivotally mounted on the finger 8*b*, but rather on a finger 70 that is mounted to rotate freely on one face of the planet wheel 46, as is the finger 8*b*, at a different place on the same planet wheel and preferably at a different distance from the center thereof.

In addition, the other difference is that, in the opening position, the connection point 8*a* of the arm 8 is situated below the finger 8*b* so that the initial position of the arm 8 is inverted relative to the position encountered in the first alternative. More precisely, in the opening position, the connection point 8*a* of the arm 8 is situated below that portion of the closed line which interconnects the points P1 and P2, as shown in FIGS. 8*a* and 8*b*.

When the finger 8*b* is situated at P1 as shown in FIG. 8*a*, the actuating arm 8 is situated parallel to the linear output direction 6*a* of the control device 1. In addition, it is also possible to see that the four axes 44, 48, 56, 58 are not only distinct and parallel, but also situated in the same diametrical plane of the ring 42. However, it is noted that this specificity is not necessary, and that this configuration in which the arm 8 occupies its closure position, the axes 56 and 58 could naturally be situated outside the plane defined by the axes 44 and 48 of the planet wheel holder 50.

In this configuration, the parameters R1, R2, d1, and d2 are preferably set in a manner such that they satisfy the following conditions:

$$R1=3\cdot R2=3\cdot d1$$

$$R1=3\cdot R2=9\cdot d2$$

This makes it possible to give the closed line L followed by the finger 8*b* and by its axis 56 a shape that is roughly an equilateral triangle whose vertices are constituted by the points P1, P2, and P3, and whose sides are slightly convex, as shown in FIG. 9.

This also makes it possible to give the closed line L' followed by the finger 70 and its axis 58 a shape that is roughly an equilateral triangle having rounded vertices and sides that are slightly convex, as can also be seen in FIG. 9.

The other elements of the control device 1 are identical or similar to those presented in the above description of the first alternative.

For this second embodiment, it is also possible to provide transmission means 14 having an additional wheel 28, as is shown in FIG. 10. Said additional wheel 28, provided in addition to the wheel described above, is situated substantially between the points P1 and P2 of the closed line L, in the vicinity of P1. In this way, at the beginning of the opening stage, the additional wheel 28 advantageously makes it possible for that portion of the cable 26 which is situated between the finger 8*b* and said wheel 28 to be kept substantially parallel to the path of said finger 8*b*. Transmission of the forces delivered by the spring 12 to the finger 8*b* during the beginning of the opening stage is thus highly optimized.

FIGS. 11*a* to 11*c* show a preferred embodiment of the means making it possible to accumulate/store the surplus energy given off during the opening stage during which the moving contact is opened under the effect of the mechanical spring, said means being designed to transfer the accumulated surplus energy to the mechanical spring, during the re-cocking phase during which said spring is re-cocked. Naturally, this type of means described for the second preferred embodiment could also be applied to the first preferred embodiment.

It can be seen that the energy recovery means are based on a flywheel, which, in this example, has the shape of a "Maltese cross" 80 that is free to turn about an axis of rotation 81. Without going beyond the ambit of the invention, the inertia of the Maltese cross can be supplemented by it being coupled to another flywheel (not shown) that turns about the same axis of rotation 81, or optionally about some other axis.

In a preferred embodiment, the Maltese cross 80 is provided with an integer number of grooves 82 that extend radially and that are sufficiently wide to make it possible, with minimized rubbing and preferably without any jolting, for a transfer finger 83 to penetrate. In a first embodiment, the transfer finger 83 describes a path associated with the connection point 8*b* of the actuating arm. For a second embodiment, the transfer finger 83 is a cylindrical shaft that is fixed orthogonally to the planet wheel 46, at a suitable distance from its center 48. The path 84 of the transfer finger 83 in the vicinity of the Maltese cross 80 is convex in shape, as shown in dashed lines in FIGS. 11*a* to 11*c*. The axis of rotation 81 and the diameter of the Maltese cross 80 are designed so that the transfer finger 83 penetrates into and exits from the groove 82 preferably tangentially to the walls of the groove in question. In addition, the Maltese cross 80 is associated with an angular indexing device (not shown) guaranteeing that a groove 82 is positioned correctly when it comes into contact with the transfer finger 83.

At the end of the opening stage, before the open position of the moving contact is reached, the transfer finger 83 penetrates into the groove 82 as shown in FIG. 11*a* and initiates turning of the Maltese cross 80 and, therefore, accumulation by said cross of the surplus kinetic energy, i.e. the kinetic energy not used directly for moving the moving contact towards its open position. While the transfer finger 83 is still engaged in the groove 82 as can be seen in FIG. 11*b*, the Maltese cross 80 reaches it maximum speed of rotation. As from this instant, which also corresponds to the end of the opening stage, and to the beginning of the re-cocking stage, and due to its high speed at the end of the opening stage, the cross delivers its kinetic energy to the spring 12 via the transfer finger 83 and the transmission means 14. The transfer of energy towards the spring during the re-cocking stage is terminated when the finger 83 exits from the groove 82, as shown in FIG. 11*c*. The speed of rotation of the Maltese cross 80 is then zero, and another groove 82 is in the correct position for receiving the finger 83 again and for transferring energy again, during the next operating cycle.

Naturally, various modifications can be made by the person skilled in the art to the control devices 1 which are described above merely by way of non-limiting example. For example, the control device 1 could be designed in a manner such that at least some of its elements are repeated symmetrically about a plane parallel to the plane in which the finger 8*b* moves.

The invention claimed is:

1. A control device for controlling electrical switchgear including a moving contact that is suitable for occupying a closed position and an open position, said control device being designed to move said moving contact and comprising a motor, a mechanical spring and an actuating arm having a first connection point and a second connection point, said control device being characterized in that said actuating arm is suitable for occupying a closure position making it possible to place the moving contact in its closed position and in which the second connection point is situated at a point P1, an opening position making it possible to place the moving contact in its open position and in which the second connection point is situated at a point P2 that is distinct from P1, and a re-cocked position in which the second connection point is situated at a point P3 that is distinct from P2 and P1, said control device being designed so that said second connection point can be moved successively along a closed line (L) including said points P1, P2, and P3:

during an opening stage for opening the moving contact, under the effect of said mechanical spring, from point P1 to point P2;

during a re-cocking stage for re-cocking the mechanical spring, under the effect of the motor being switched on, and while keeping the moving contact in the open position, from point P2 to point P3; and during a closure stage for closing the moving contact, also under the effect of the motor being switched on, from point P3 to P1.

2. A control device according to claim 1, characterized in that it is designed so that, during said closure stage for closing the moving contact, resulting in said second connection point being moved from point P3 to point P1, the energy stored in the mechanical spring (12) does not vary.

3. A control device according to claim 1 or claim 2, characterized in that said closed line (L) has a shape that is roughly a triangle.

4. A control device according to claim 3, characterized in that closed line (L) has a shape that is roughly a triangle, the points P1, P2, P3 constituting the vertices of said triangle.

5. A control device according to claim 1, characterized in that it is designed so that said opening stage for opening the moving contact, resulting in said second connection point being moved from point P1 to point P2, is performed under the effect of the mechanical spring only, or is performed in a manner such that the motor assists said mechanical spring.

6. A control device according to claim 1, characterized in that it is designed so as to deliver a linear or rotary output movement to the moving contact.

7. A control device according to claim 1, characterized in that said motor is a servomotor.

8. A control device according to claim 1, characterized in that the position of the moving contact is servo-controlled during said closure stage, relative to a setpoint that is in the form of a mathematical function of time.

9. A control device according to claim 1, characterized in that the speed of the moving contact is servo-controlled during said closure stage, relative to a setpoint in the form of a mathematical function of time.

10. A control device according to claim 1, characterized in that the acceleration of the moving contact is servo-controlled during the closure stage, relative to a setpoint in the form of a mathematical function of time.

11. A control device according to claim 1, characterized in that it further comprises means making it possible to accumulate the energy that is given off during said opening stage for opening the moving contact under the effect of the mechanical spring, said means being designed to transfer said accumulated energy to said mechanical spring, during said re-cocking stage for re-cocking said spring.

12. A control device according to claim 11, characterized in that said means making it possible to store the surplus energy comprise a flywheel capable of being caused to turn under the action of a moving part, the flywheel being such as a Maltese cross.

13. A control device according to claim 1, characterized in that said second connection point of the actuating arm is constituted by a finger guided along a path defined at least in part physically on a stationary body, and following said closed line (L).

14. A control device according to claim 13, characterized in that it further comprises transmission means interposed between said mechanical spring and said actuating arm, said transmission means being connected pivotally to said finger.

15. A control device according to claim 14, characterized in that said transmission means are in the form of a chain or a cable that is kept under tension continuously while the actuating arm is being put in motion.

16. A control device according to claim 15, characterized in that said transmission mean are in the form of a chain or a cable that is kept under tension continuously via at least one wheel while the actuating arm is being put in motion.

17. A control device according claim 13, characterized in that said portion of the closed line (L) which is defined between the points P1 and P2 is rectilinear at least in part.

18. A control device according to claim 17, characterized in that said portion of the closed line (L) which is defined between the points P1 and P2 is rectilinear.

19. A control device according to claim 17, characterized in that it is designed so that when the second connection point is situated at point P1, the actuating arm, the transmission means and an axis of said mechanical spring are aligned.

20. A control device according to claim 19, characterized in that it is designed so that when the second connection point is situated at point P1, the actuating arm, the transmission means and the axis of said mechanical spring are aligned in a direction defined by the points P1 and P2.

21. A control device according to claim 13, characterized in that said portion of the closed line (L) which is defined between the points P1 and P2 is a portion that is concave in shape, at least in part.

22. A control device according to claim 13, characterized in that said portion of the closed line (L) which is defined between the points P1 and P2 is a portion that is convex in shape, at least in part.

23. A control device according 13, characterized in that the two portions of the closed line (L) that are defined respectively between the points P2 and P3, and between the points P3 and P1 are portions that are convex in shape, at least in part.

24. A control device according to claim 13, characterized in that the two portions of the closed line (L) that are defined respectively between the points P2 and P3, and between the points P3 and P1 are portions that are concave in shape, at least in part.

25. A control device according to claim 13, characterized in that it further comprises a first control lever driven by said motor in a manner such that it is capable of bringing said finger from point P2 to point P3 by being in contact with said finger.

26. A control device according to claim 25 in combination, characterized in that it is designed so that said first and second control levers are put in motion simultaneously by said motor, during the re-cocking phase for re-cocking the mechanical spring and during the closure stage for closing the moving contact.

27. A control device according to claim 25 in combination, characterized in that it is designed so that said first and second control levers are put in motion independently by said motor, respectively during the re-cocking stage for re-cocking the mechanical spring and during the closure stage for closing the moving contact.

28. A control device according to claim 13, characterized in that it further comprises a second control lever driven by said motor in a manner such that it is capable of bringing said finger from said point P3 to point P1 by being in contact with said finger.

29. A control device according to claim 1, characterized in that said second connection point of the actuating arm is constituted by a finger guided in a groove extending along said closed line (L) and provided in a stationary body.

30. A control device according to claim 1, characterized in that it further comprises a gear system provided with a stationary inner ring of radius R1, with a planet wheel of radius R2 that meshes externally with said ring, and with a planet wheel holder having a rotary shaft arranged on a central axis of said inner ring, said second connection point of the actuating arm being constituted by a finger that is rotatably mounted on said planet wheel, said planet wheel having a central axis that is parallel to a central axis of the finger and that is spaced apart therefrom by a distance d1.

31. A control device according to claim 30, characterized in that it further comprises transmission means interposed between said mechanical spring and said actuating arm, said transmission means being connected pivotally to said planet wheel so as to be capable of pivoting relative thereto about a pivot axis that is parallel to the central axis of the planet wheel and that is spaced apart therefrom by a distance d2.

32. A control device according to claim 31, characterized in that said transmission means are in the form of a chain or a cable that is kept under tension continuously while the actuating arm is being put in motion.

33. A control device according to claim 32, characterized in that said transmission means are in the form of a chain or of a cable that is kept under tension continuously via at least one wheel while the actuating arm is being put in motion.

34. A control device according to claim 31, characterized in that said pivot axis of the transmission means and said central axis of the finger coincide, implying that the parameters d1 and d2 are equal.

35. A control device according to claim 34, characterized in that the parameters R1, R2 and d1 are set in a manner such that they satisfy the following condition:

$$2>d1/R2>0.2 \quad (3)$$

36. A control device according to claim 35, characterized in that the parameters R1, R2 and d1 are set in a manner such that they satisfy the following condition:

$$R1/R2=3 \quad (2)$$

$$d1/R2=1/3 \quad (4)$$

37. A control device according to claim 31, characterized in that said pivot axis of the transmission means and said central axis of the finger are distinct.

38. A control device according to claim 37, characterized in that the parameters R1, R2, d1, and d2 are set in a manner such that they satisfy the following conditions:

$$2>d1/R2>0.2 \quad (3)$$

$$2>d2/R2>0.2 \quad (5)$$

39. A control device according to claim 38, characterized in that the parameters R1, R2, d1, and d2 are set in a manner such that they satisfy the following conditions:

$$R1/R2=3 \quad (2)$$

$$d1/R2=1 \quad (6)$$

$$d2/R2=1/3 \quad (7)$$

40. A control device according to claim 30, characterized in that the parameters R1 and R2 are set in a manner such that they satisfy the following condition:

$$5>R1/R2>1 \quad (1)$$

41. A control device according to claim 40, characterized in that the parameters R1 and R2 are set in a manner such that they satisfy the following condition:

$$R1/R2=3 \quad (2)$$

42. A control device according to claim 30, characterized in that said gear system is further provided with a toothed wheel driven by said motor and rotatably mounted on said rotary shaft of the planet wheel holder, said toothed wheel being coupled mechanically to said planet wheel holder so as to allow said planet wheel holder to turn freely about its shaft during the opening stage for opening the moving contact during which said finger is moved from point P1 to point P2 under the effect of the mechanical spring, and so as to entrain said planet wheel holder in rotation with it during the re-cocking stage for re-cocking the spring and during the closure stage for closing the moving contact, during which stages the finger is moved respectively from point P2 to point P3 and from point P3 to P1, under the effect of the motor being switched on, thereby causing said toothed wheel to turn.

43. A control device according to claim 42, characterized in that said toothed wheel is coupled mechanically to said planet wheel holder via a circular groove provided over an angular sector of said toothed wheel, and passing a shaft of the planet wheel holder, which shaft carries said planet wheel in freely rotatable manner and is arranged on the central axis of said planet wheel.

44. A control device according to claim 30, characterized in that the motor is designed to assist the spring during the opening stage.

45. A control device according to any one of claim 30, characterized in that the motor is designed to assist the spring during a portion only of the opening stage.

46. A control device according to claim 30, characterized in that the motor is designed to assist the spring and makes it possible, during the opening stage, to servo-control the position of the moving contact relative to a setpoint that is in the form of a mathematical function of time.

47. A control device according to claim 30, characterized in that the motor is designed to assist the spring and makes it possible, during the opening stage, to servo-control the speed of the moving contact relative to a setpoint that is in the form of a mathematical function of time.

48. A control device according to claim 30, characterized in that the motor is designed to assist the spring and makes it possible, during the opening stage, to servo-control the acceleration of the moving contact relative to a setpoint that is in the form of a mathematical function of time.

49. Electrical switchgear having a moving contact suitable for occupying a closed position and an open position, said electrical switchgear being characterized in that it includes a control device according to claim 1.

50. A method of controlling electrical switchgear, said method being characterized in that it is implemented by means of a control device according to claim 1, said method comprising the following successive steps of:

- opening of the moving contact, under the effect of said mechanical spring, from point P1 to point P2;
- re-cocking of the mechanical spring, under the effect of the motor being switched on, and while keeping the moving contact in the open position, from point P2 to point P3; and
- closing of the moving contact, also under the effect of the motor being switched on, from point P3 to P1.

* * * * *